US007031629B2

(12) United States Patent
Kawamura et al.

(10) Patent No.: US 7,031,629 B2
(45) Date of Patent: Apr. 18, 2006

(54) IMAGE FORMING APPARATUS WHICH RECOVERS TONER BY DEVELOPING DEVICE

(75) Inventors: Takeshi Kawamura, Shizuoka-ken (JP); Koichi Otaka, Shizuoka-ken (JP); Yasushi Shimizu, Shizuoka-ken (JP); Yasunori Chigono, Susono (JP); Ken Nakagawa, Mishima (JP); Hikaru Osada, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 10/413,482

(22) Filed: Apr. 15, 2003

(65) Prior Publication Data

US 2004/0005160 A1 Jan. 8, 2004

(30) Foreign Application Priority Data

Apr. 15, 2002 (JP) ..... 2002-111947
Apr. 9, 2003 (JP) ..... 2003-105302

(51) Int. Cl.
*G03G 15/06* (2006.01)
*G03G 15/30* (2006.01)

(52) U.S. Cl. ..... 399/55; 399/149

(58) Field of Classification Search ..... 399/55, 399/149, 150

See application file for complete search history.

(56) References Cited

U.S. PATENT DOCUMENTS 4,999,782 A * 3/1991 BeVan ..... 399/270
5,805,960 A * 9/1998 Suzuki et al. ..... 399/149
6,002,900 A 12/1999 Ishiyama ..... 399/149
6,128,456 A 10/2000 Chigono et al. ..... 399/176
6,167,212 A 12/2000 Satoh et al. ..... 399/55
6,173,144 B1 1/2001 Hirabayashi et al. ..... 399/222
6,226,480 B1 * 5/2001 Hirabayashi et al. ..... 399/222
6,272,306 B1 8/2001 Saito et al. ..... 399/270
6,438,331 B1 8/2002 Sakaizawa et al. ..... 399/50
6,442,362 B1 8/2002 Hirabayashi et al. ..... 399/149
6,463,245 B1 10/2002 Suwa et al. ..... 399/274
2002/0159784 A1 10/2002 Yoshioka et al. ..... 399/66

FOREIGN PATENT DOCUMENTS

JP 10-307456 11/1998
JP 11-65234 3/1999
JP 2000122388 A * 4/2000
JP 2000267407 A * 9/2000
JP 2001-188405 7/2001
JP 2001-188454 7/2001

* cited by examiner

*Primary Examiner*—Quana Grainger
(74) *Attorney, Agent, or Firm*—Fitzpatrick, Cella, Harper & Scinto

(57) ABSTRACT

An image forming apparatus includes an image bearing member; a charging member for electrically charging the image bearing member; developing means for developing with a developer an electrostatic latent image formed on the image bearing member, the developing means having a developer carrying member for carrying the developer, wherein a gap is formed between the developer carrying member and the image bearing member; bias voltage applying means for applying a bias voltage to the developer carrying member, wherein the bias applying means applies an AC bias when the electrostatic latent image is developed, wherein the developing means is capable of collecting the developer fro the image bearing member, and an amplitude of an AC bias voltage applied to the developer carrying member by the bias applying means when the the developer is collected, is larger than that when the the electrostatic latent image is developed.

40 Claims, 10 Drawing Sheets

IMAGE FORMING APPARATUS WHICH RECOVERS TONER BY DEVELOPING DEVICE

FIELD OF THE INVENTION AND RELATED ART

The present invention relates to an image forming apparatus, for example, a copying machine, a printer, etc., which employs an electrophotographic or electrostatic recording method. In particular, it relates to an image forming apparatus which recovers toner with the use of its developing device, while employing an electrophotographic or electrostatic recording method.

FIG. 7 shows the general structure of one of the examples of a cleaner-less electrophotographic image forming apparatus, which is useful as reference for understanding the present invention.

Designated by a referential numeral 1 is an electrophotographic photoconductive member as an image bearing member, which normally is in the form of a drum (which hereinafter will be referred to as photoconductive drum). It is rotationally driven in the direction indicated by an arrow mark at a predetermined peripheral velocity. This rotational photoconductive drum 1 is uniformly charged by a primary charging device 3.

In this example, the primary charging device 3 is a contact type charging device employing a charge roller (electrically conductive roller), as a contact type charging member, which is placed in contact with the photoconductive drum 1. A referential character a represents a charging nip. As a predetermined combination of a DC voltage and an AC voltage is applied from an electrical power source 6 to this charge roller 3, the peripheral surface of the photoconductive drum 1 is uniformly charged to predetermined polarity and potential level by the charge roller 3 in contact with the peripheral surface of the photoconductive drum 1.

At the exposure location b, the uniformly charged portion of the peripheral surface of the photoconductive drum 1 is exposed to the light, projected from an exposing apparatus 4, while being modulated with the image formation information inputted from an external apparatus. As a result, a latent image is formed on the peripheral surface of the photoconductive drum 1.

At the development location c of a developing apparatus 2, this electrostatic latent image on the photoconductive drum 1 is visualized into a toner image with the use of developer (which hereinafter may sometimes be referred to as toner) T holding triboelectrical charge, the polarity of which is the same as that of the voltage applied to the primary charging device 3.

Also in this example, the developing apparatus 2 is such a developing apparatus that uses single-component magnetic developer. In operation, while a developer bearing member (which hereinafter will be referred to as development roller) 21, in which a magnet is stationarily disposed, is rotated, the toner T in the toner container is sent out by a toner sending member 23, to the adjacencies of the peripheral surface of the development roller 21. As a result, a layer of triboelectrically charged toner is formed on the peripheral surface of the development roller 21 by a developer regulating member (which hereinafter will be referred to as development blade) 22 for regulating the body of toner on the peripheral surface of the development roller 21. The development roller 21 is rotated in the direction indicated by an arrow mark in the drawing, so that the peripheral surfaces of the photoconductive drum 1 and development roller 21 are moved in the same direction at the development location c, where a predetermined gap is maintained between the peripheral surfaces of the photoconductive drum 1 and development roller 21.

To the development roller 21, a predetermined combination of a DC voltage and an AC voltage is applied from an electric power source 8. As a result, the electrically charged toner particles in the toner layer on the development roller 21 are transferred onto the peripheral surface of the photoconductive drum 1 in a manner to reflect the pattern of the electrostatic latent image on the peripheral surface of the photoconductive drum 1. Consequently, a visible image reflecting the electrostatic latent image is formed of toner particles, on the peripheral surface of the photoconductive drum 1. This visible image hereinafter will be referred to as a toner image.

In synchronism with the toner image formation, a single sheet or a plurality of sheets of paper (transfer medium) P are conveyed by a conveying means comprising a pickup roller 10, etc., from a cassette to a transfer nip d, in which the toner image is transferred onto the transfer medium P by a transfer charging device (transfer roller) 5. Thereafter, the transfer medium P is separated from the photoconductive drum 1, and is conveyed to a fixing apparatus 9. In the fixing apparatus 9, the toner image is fixed; it is turned into a permanent image.

Meanwhile, the developer particles remaining on the photoconductive drum 1 (which hereinafter will be referred to as transfer residual toner particles), that is, the developer particles which were not transferred by the transfer charging device 5, are recovered by the developing apparatus 2. More specifically, during the following rotational cycle of the photoconductive drum 1, the peripheral surface of the photoconductive drum 1 is charged, with the presence of the transfer residual toner particles T on the peripheral surface of the photoconductive drum 1, and a latent image is formed on the peripheral surface of the photoconductive drum by exposure, also with the presence of the transfer residual toner particles T. Then, while a toner image is formed by the developing apparatus 2 using the single-component magnetic developer, the transfer residual toner particles T are recovered into the developing apparatus 2. This process will be referred to as "cleaning by development bias".

At this time, the mechanism of the "cleaning by development bias" will be described, in this mechanism, the residual toner particles, that is, the toner particles remaining on the portion of the peripheral surface of the photoconductive drum 1, on the immediately downstream side of the aforementioned transferring means, in terms of the rotational direction of the photoconductive drum, are recovered by the fog prevention bias (difference Vback in potential level between potential level of DC voltage applied to developing means and surface potential level of photoconductive drum 1), during the immediately following rotational cycle of the photoconductive drum, during which the photoconductive drum 1 is charged, a latent image is formed; and the latent image is developed (Japanese Laid-open Patent Application 10-307456, etc.).

In the case of the above described method, which is generically referred to as a cleaner-less system, the transfer residual toner particles are recovered by the developing means, and are used during the following image formation processes. Therefore, it prevents an image forming apparatus from producing waste toner, reducing thereby the amount of the labor required for maintenance.

Being cleaner-less offers a substantial advantage in terms of spatial efficiency; it makes it possible to substantially reduce the size of an image formation apparatus.

Also in the case of a cleaner-less method, a direct injection method is employed by the charging means. More specifically, a contact type charging member, the electrical resistance of which is in the medium range, is placed in contact with the peripheral surface of a photoconductive drum to directly inject electric charge into the surface layer of the photoconductive drum.

However, the residual toner recovery by the developing apparatus is not perfect. In other words, it is likely to allow the occurrence of the image defect called fog. Further, as a given image forming operation is repeatedly carried out, not only is the fog likely to be produced by a greater amount, but also, other irregularities, in particular, an image defect called "light blockage blemish", sometimes occurs.

The causes of the image defects, causes of the increase in the frequency of the occurrences of the image defects, and causes of the increase in the magnitude of the image defects, which became evident through the studies made by the inventors of the present invention, will be discussed next.

a) Fog

First, the fog will be described. When a contact type charging member is used, the transfer residual toner particles, or the toner particles left on the photoconductive drum without being transferred onto the recording medium by the transferring means, are taken into the contact type charging member once before they are recovered. Generally, toner particles are insulating. Therefore, the presence of a larger amount of toner particles in or on the, contact type charging member causes charge failure. Thus, bias is applied to the contact type charging member to return the transfer residual toner particles in and on the contact type charging member to the photoconductive drum. Then, the transfer residual toner particles reach the developing means, and are recovered into the developing device by the recovery bias of the developing means.

This does not mean that all the transfer residual toner particles are returned into the developing device. In other words, a certain amount of the transfer residual toner particles still remains on the photoconductive drum, on the points unrelated to the current electrostatic latent image. As a result, the image defect called fog occurs.

Moreover, as a toner particle is repeatedly subjected to an image forming operation, the toner particle deteriorates; some of external additives, such as silica, etc., adhering to the toner particle peel off. As a result, the performance of the toner particle in terms of electrical properties reduces. In other words, as the toner particle deteriorates, it is likely to turn into the transfer residual toner particle, and also, is less likely to be recovered by the developing means, increasing thereby the frequency at which the fog is generated.

b) Image Discontinuity

Next, an image defect referred to as "discontinuity" will be described.

The application of particle expulsion bias to the contact type charging member does not make the contact type charging member expel all the toner particles therein or thereon. Therefore, as the cumulative number of the image forming operations carried out by an image forming apparatus increases, the amount of the transfer residual particles accumulated in and on the contact type charging member increases. Generally, a toner particle is an insulating particle. Thus, the presence of a large amount of toner particles between the peripheral surfaces of the charge roller and photoconductive drum, in the charging nip, prevents the peripheral surface of the photoconductive drum from being uniformly charged. As a result, an image, the portions of which corresponding to the nonuniformly charged portions of the photoconductive drum are abnormal, that is, being discontinuous, is formed. When the cumulative amount of the transfer residual toner particles exceeds a certain level, the chance of the occurrence of this image anomaly is very high.

c) Light Blockage Blemish

Next, an image defect referred to as "light blockage blemish" will be described. This term means a phenomenon that the presence of a large amount of particles, such as toner particles, on the peripheral surface of the photoconductive drum blocks exposure light, preventing thereby the formation of a toner image. As a result, an image, the portions of which corresponding to the portions of the peripheral surface of the photoconductive drum covered with the unwanted particles, are missing, is formed.

SUMMARY OF THE INVENTION

The present invention was made in consideration of the above described problems, and its primary object is to provide an image forming apparatus capable of forming images free of defects.

Another object of the present invention is to provide an image forming apparatus superior in the ratio at which developer is recovered by its developing device.

Another object of the present invention is to provide an image forming apparatus comprising:

an image bearing member;

a charging member for charging said image bearing member;

developing means for developing the electrostatic latent image formed on said image bearing member with the use of developer, said developing means having a developer bearing member for bearing the developer, and a gap being provided between said developer bearing member and said image bearing member; and bias applying means for applying bias to said developer bearing member, said bias applying means applying AC bias while developing the electrostatic latent image;

wherein said developing means is capable of recovering the developer from said image bearing member, and the amplitude of the AC bias which said bias applying means applies to said developer bearing member during the developer recovery is greater than that during the electrostatic latent image development.

Another object of the present invention is to provide an image forming apparatus comprising:

an image bearing member;

a charging member for charging said image bearing member;

developing means for developing the electrostatic latent image formed on said image bearing member with the use of developer, said developing means having a developer bearing member for bearing the developer, and a gap being provided between said developer bearing member and said image bearing member; and bias applying means for applying bias to said developer bearing member, said bias applying means applying AC bias while developing the electrostatic latent image;

wherein said developing means is capable of recovering the developer from said image bearing member, and the duty ratio of the AC bias which said bias applying means applies to said developer bearing member during the developer recovery is different from that during the electrostatic latent image development.

Another object of the present invention is to provide an image forming apparatus comprising:

an image bearing member;

a charging member for charging said image bearing member;

developing means for developing the electrostatic latent image formed on said image bearing member with the use of developer, said developing means having a developer bearing member for bearing the developer, and a gap being provided between said developer bearing member and said image bearing member; and bias applying means for applying bias to said developer bearing member, said bias applying means applying AC bias while developing the electrostatic latent image;

wherein said developing means is capable of recovering the developer from said image bearing member, and the frequency of the AC bias which said bias applying means applies to said developer bearing member during the developer recovery is higher than that during the electrostatic latent image development.

Another object of the present invention is to provide an image forming apparatus comprising:

an image bearing member;

a first bias applying means for applying bias to said charging member, said first bias applying means being capable of applying a first bias, that is, the bias applied during the formation of an electrostatic latent image on said image bearing member, and a second bias different from the first bias;

developing means for developing the electrostatic latent image formed on said image bearing member with the use of developer, said developing means having a developer bearing member for bearing the developer, and a gap being provided between said developer bearing member and said image bearing member; and a second bias applying means for applying bias to said developer bearing member, said second bias applying means applying AC bias during the electrostatic latent image development;

wherein while the area of said image bearing member, to which said first bias applying means has applied the second bias, passes the development location, said second bias applying means applies thereto, AC bias greater in amplitude than the AC bias applied during the electrostatic latent image development.

Another object of the present invention is to provide an image forming apparatus comprising:

an image bearing member;

a first bias applying means for applying bias to said charging member, said first bias applying means being capable of applying a first bias, that is, the bias applied during the formation of an electrostatic latent image on said image bearing member, and a second bias different from the first bias;

developing means for developing the electrostatic latent image formed on said image bearing member with the use of developer, said developing means having a developer bearing member for bearing the developer, and a gap being provided between said developer bearing member and said image bearing member; and a second bias applying means for applying bias to said developer bearing member, said second bias applying means applying AC bias during the electrostatic latent image development;

wherein while the area of said image bearing member, to which said first bias applying means has applied the second bias, passes the development location, said second bias applying means applies thereto, AC bias different in duty ratio from the AC bias applied during the electrostatic latent image development.

Another object of the present invention is to provide an image forming apparatus comprising:

an image bearing member;

a first bias applying means for applying bias to said charging member, said first bias applying means being capable of applying a first bias, that is, the bias applied during the formation of an electrostatic latent image on said image bearing member, and a second bias different from the first bias;

developing means for developing the electrostatic latent image formed on said image bearing member with the use of developer, said developing means having a developer bearing member for bearing the developer, and a gap being provided between said developer bearing member and said image bearing member; and a second bias applying means for applying bias to said developer bearing member, said second bias applying means applying AC bias during the electrostatic latent image development;

wherein while the area of said image bearing member, to which said first bias applying means has applied the second bias, passes the development location, said second bias applying means applies thereto, AC bias higher in frequency than the AC bias applied during the electrostatic latent image development.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the embodiments of the present invention will be described with reference to the appended drawings.

(Embodiment 1)

Figure 1:
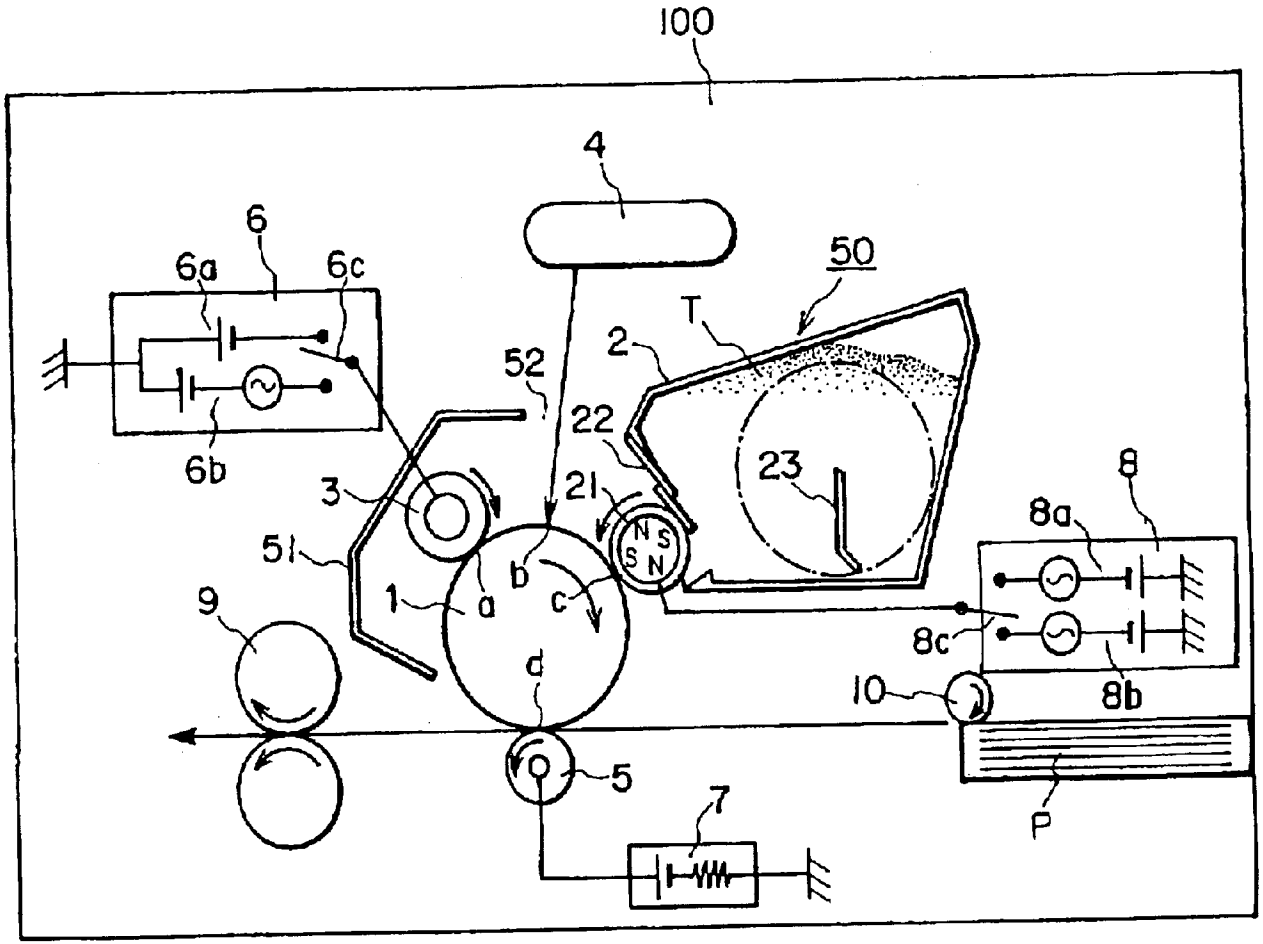
FIG. 1 is a drawing for describing the structure of the image forming apparatus in the first embodiment of the present invention.
Figure 7:
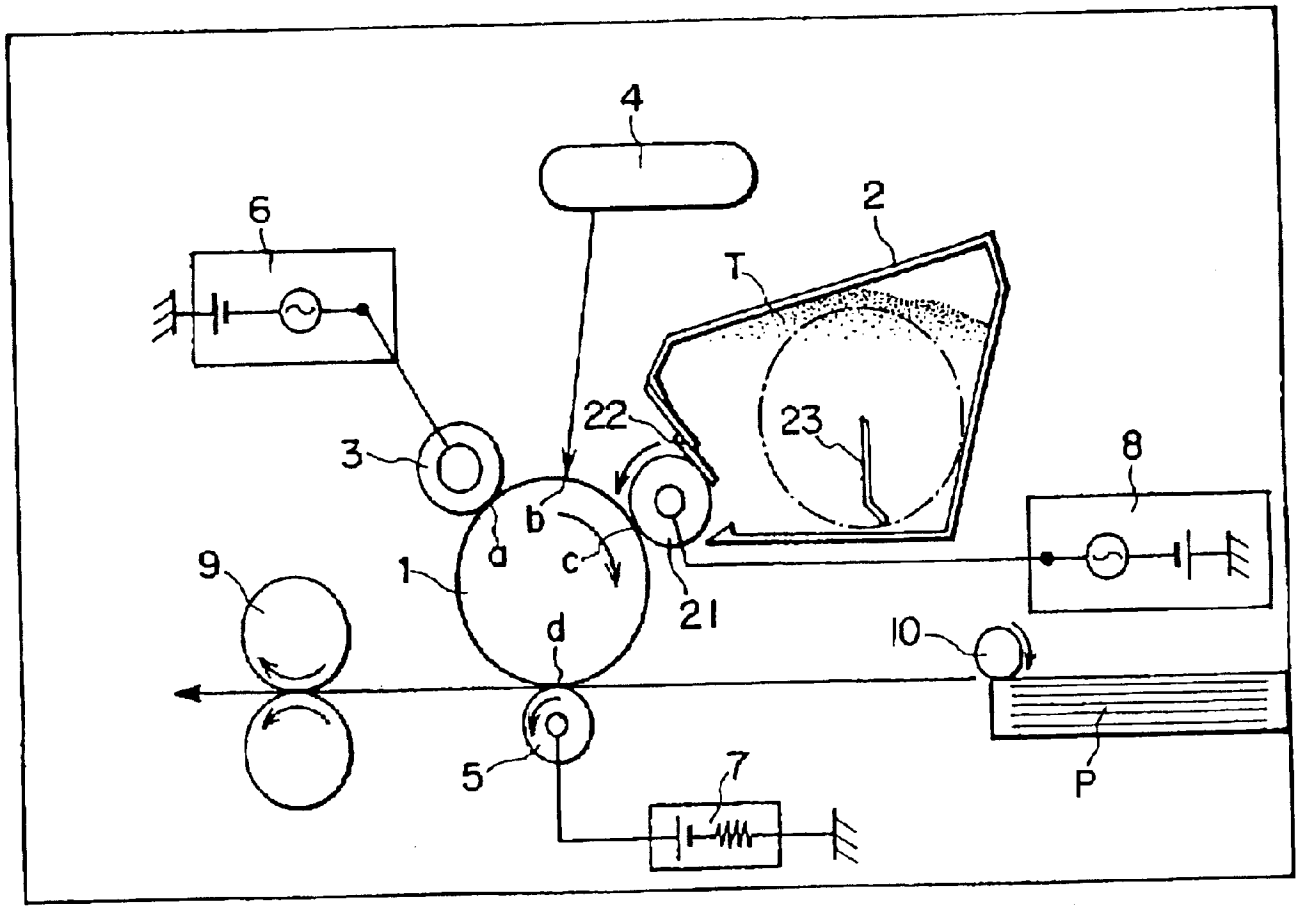
FIG. 7 is a schematic drawing of an electrophotographic apparatus useful as a reference for understanding the present invention.

The image forming apparatus in this embodiment is shown in FIG. 1. Like the previously described image forming apparatus shown in FIG. 7, this image forming apparatus is an electrophotographic printer, the charging means of which is a contact type charging device employing a charge roller 3 as a contact type charging member; the developing means of which is a developing apparatus which uses single-component magnetic developer; and the cleaning method of which is of a cleaner-less type (cleaning process coincides with the developing process). The structural members of this image forming apparatus, which are identical to those of the image forming apparatus in FIG. 7 will be given the same referential symbols as those given to those of the image forming apparatus in FIG. 7. In order to avoid the repetition of the same descriptions.

(1-1) Essential Members of Image Forming Apparatus 100

The charger roller 3, as a charging member, of the image forming apparatus in this embodiment is a roller comprising a metallic core, and an elastic layer formed in a manner to cover the entirety of the peripheral surface of the metallic core. The material for the elastic layer is rubber, or foamed substance, the electrical resistance of which is in a range of $10^4$–$10^7$ Ω·cm, and which has been processed with resin, sulfidizing agent, foaming agent, etc.

The photoconductive drum 1 as an image bearing member is an organic photoconductive drum comprising an electrically conductive drum (aluminum drum), as a substrate, and a plurality of functional layers, that is, an undercoat layer, a charge generation layer, and a charge transfer layer, coated in this order in layers on the entirety of the peripheral surface of the drum.

The development roller 21 as a developer bearing member is a nonmagnetic roller comprising a piece of plain aluminum tube, and a layer of material coated on the entirety of the peripheral surface of the aluminum tube in order to provide the development roller 21 with a peripheral surface with a proper degree of roughness.

The development blade 22 as a toner regulating member is a blade comprising an elastic blade proper formed of urethane, and a metallic plate to which the blade proper is bonded.

The transferring means 5 is a transfer roller, which is electrically conductive and elastic.

Further, the image forming apparatus in this embodiment employs a process cartridge 50. In which the three processing devices, that is, the photoconductive drum 1, charge roller 3, and developing apparatus 2, are integrally disposed, and which is removably mountable in the main assembly of the image forming apparatus.

The image forming apparatus also comprises an electric power source 6 (first bias applying means), which is for applying charge bias to the charge roller 3, and which has first and second power sources 6*a* and 6*b*, and a switch 6*c* for switching between the power sources 6*a* and 6*b*. While the charge roller 3 is in connection to the first power source 6*a* through the switch 6*c*, a predetermined DC bias is applied to the charge roller 3, and as the switch is made in the electric power source 6 from the first power source 6*a* to the second power source 6*b* by the switch 6*c*, a predetermined combination of a DC voltage and an AC voltage is applied to the charge roller 3.

Further, the image forming apparatus comprises an electric power source 8 (second bias applying means), which is for applying development bias to the development roller 21, and which has first and second power sources 8*a* and 8*b*, and a switch 8*c* for switching between the first and second power sources 8*a* and 8*b*. While the development roller 21 is in connection to the first power source 8*a* through the switch 6*c*, a predetermined combination of a DC voltage and an AC voltage is applied to the development roller 21, and as the switch is made in the electric power source 8 from the first power source 8*a* to the second power source 8*b* by the switch 8*c*, a predetermined combination of a DC voltage and an AC voltage, which is different from that applied by the first power source 8*a*, is applied to the development roller 21.

The power source selection switch 6*c* of the electric power source 6 for the charge bias application, and the power source selection switch 8*c* of the electric power source 8 for the development bias application, are controlled by an unshown control circuit, following a predetermined sequence program.

(1-2) Structure of Image Forming Apparatus

The photoconductive drum 1 is rotationally driven in the direction indicated by an arrow mark at a predetermined peripheral velocity. The charge roller 3 is kept pressed directly on the photoconductive drum 1 so that a predetermined amount of contact pressure is maintained between the charge roller 3 and photoconductive drum 1, and also so that a charge nip having a predetermined width is maintained between the charger roller 3 and photoconductive drum 1. The charge roller 3 is rotationally driven in such a direction that the peripheral surface of the charge roller 3 moves in the direction counter to the moving direction of the peripheral surface of the photoconductive drum 1, in the charging nip a, providing thereby the charge roller 3 with a differential peripheral velocity of 150% relative to the peripheral surface of the photoconductive drum 1.

During an image forming operation, the switch 6*c* of the electric power source 6 for applying charge bias is set to the first power source 6*a*, so that a DC charge bias of −600 V is applied to the charge roller 3, uniformly charging the peripheral surface of the photoconductive drum 1 to a predetermined potential level.

Onto this charged peripheral surface of the photoconductive drum 1, a beam of laser light is projected from an optical means 4, through the exposure opening 52 of the cartridge frame 51; the charged peripheral surface of the photoconductive drum is exposed. As a result, an electrostatic latent image is formed on the peripheral surface of the photoconductive drum 1. This electrostatic latent image is developed into a visual image, that is, an image formed of toner (which hereinafter will be referred to as toner image), by the developing apparatus 2 as a developing means.

This developing apparatus 2 is of a reversal type, which uses single-component, magnetic, negative toner, and a jumping developing method. In operation, while the development roller 21 is rotated, the toner T in the toner container is sent out by a toner stirring member 23, to the adjacencies of the peripheral surface of the development roller 21. As a result, a layer of triboelectrically charged toner is formed on the peripheral surface of the development roller 21 by the development blade 22 for regulating the body of toner on the peripheral surface of the development roller 21. From this layer of toner, toner particles are transferred onto the photoconductive drum 1 in a manner to reflect the pattern of the electrostatic latent image on the photoconductive drum 1, developing thereby the electrostatic latent image into a visible image, that is an image formed of toner. A gap is maintained between the photoconductive drum and development roller; the layer of developer on the development roller is not in contact with the peripheral surface of the photoconductive drum. As a predetermined AC bias is applied to the development roller, a certain amount of the developer on the development roller transfers onto the photoconductive drum.

Thereafter, the toner image is transferred onto a sheet of paper P by applying a predetermined voltage opposite in polarity to the toner image to a transfer roller 5 from an electric power source 7 for transfer bias application.

Toner particles remaining on the photoconductive drum 1, that is, toner particles which were not transferred onto the photoconductive drum 1, are recovered into the developing apparatus 2 by the developing apparatus 2.

(1-3) Characteristics of Image Forming Apparatus 100

Figure 2:
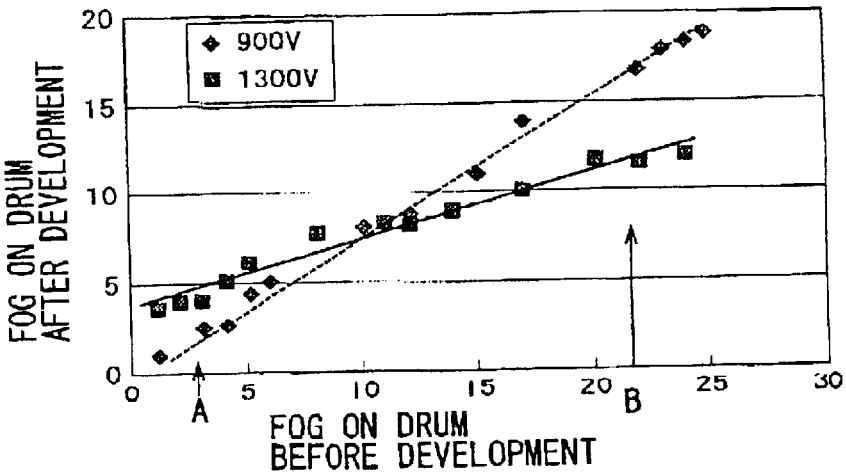
FIG. 2 is a drawing for describing the relationship between the pre-development fog and post-development fog, in the first embodiment of the present invention.

As the cumulative number of image forming operations carried out by the image forming apparatus 100 increases, the amount of the transfer residual toner particles on the peripheral surface of the photoconductive drum 1 also increases, their presence becoming conspicuous. These transfer residual toner particles have the following characteristics FIG. 2 shows the relationship between the fog causing toner particles on the portion of the peripheral surface of the photoconductive drum 1 between the charging location and developing location (which hereinafter will be referred to as pre-development fog), and the fog causing toner particles on the portion of the peripheral surface of the photoconductive drum 1 between the developing location and transferring location (which hereinafter will be referred to as post-development fog). The solid line in FIG. 2 represents the case in which the peak-to-peak voltage of the AC bias applied to the development roller was 1,300 V, and the broken line (dotted line) in FIG. 2 represents the case in which it was 900 V. The amounts of these fog causing particles on the peripheral surface of the photoconductive drum were measured with the use of a fog measuring device, that is, a Densitometer TC-6DS (Tokyo Denshoku, Co., Ltd.) of a reflection type.

As will be evident from FIG. 2, when the amount of the pre-development fog was relatively small (point A in FIG. 2), the amount of the post-development fog is smaller when the Vpp of the AC bias was 900 V than when the Vpp of the AC bias was 1,300 V. In other words, when the peripheral surface of the photoconductive drum was clean, the effect of the fog causing toner particles was large, and the greater the amplitude of the development bias, the greater the amount of the fog. On the contrary, when the amount of the pre-development fog was relatively large (point B in FIG. 2), the amount of the post-development fog was smaller when the Vpp of the AC bias was 1,300 V than when it was 900 V. The causes of these phenomenons are assumed to be as follows.

That is, the greater the amplitude of the development bias, the smaller the amount of the triboelectrical charge (which hereinafter will be referred to as "tribo") of each toner particle, which is necessary for the toner particle to jump to the photoconductive drum, can be. However, when the tribo of a toner particle is small, the amount of the force generated by the interaction between the tribo of the toner particle and the electrical charge of the peripheral surface of the photoconductive drum is not likely to be large enough to return the toner particle to the developing device (development roller). Therefore, the toner particle is likely to remain on the photoconductive drum, as a fog generating toner particle. In other words, the application of the bias with the greater amplitude, that is, the AC bias of 1,300 V, when the amount of the pre-development fog is relatively small, that is, when the amount of the toner particles adhering to the peripheral surface of the photoconductive drum is relatively small anyway, contributes to the contamination of the relatively clean peripheral surface of the photoconductive drum; it increases the post-development fog.

However, the greater the amplitude of the development bias, the greater the amount of the toner particles which jump from the developing device to the photoconductive drum. Then, when the difference in potential level between the development roller and photoconductive drum is such that the toner particles are caused to jump from the photoconductive drum to the development roller, the toner particles having jumped from the development roller to the photoconductive drum return to the development roller, taking along the toner particles which pre-existed on the photoconductive drum. In other words, the toner particles on the photoconductive drum are returned to the developing device by the so-called "powder pressure". The powder pressure is higher when the amplitude of the AC voltage applied to the development roller is 1,300 V than when it is 900 V. Therefore, the application of an AC bias with the larger amplitude, that is, the AC voltage of 1,300 V, when the amount of the pre-development fog is relatively large, that is, when the amount of toner particles adhering to the peripheral surface of the photoconductive drum is relatively large, contributes more to the cleaning of the relatively contaminated peripheral surface of the photoconductive drum than to the adhesion of the toner particles to the peripheral surface of the photoconductive drum; it decreases the post-development fog.

(1-4) Operation and Bias Values of Image Forming Apparatus in This Embodiment

The values of the biases in this embodiment are determined based on the above described development process. In order to prevent fog generation while maintaining the charging performance of the charge roller, it is necessary to properly expel the toner particles from the charge roller, and also to recover virtually the entirety of the expelled toner particles into the developing device. However, if a large amount of toner particles is expelled onto the peripheral surface of the photoconductive drum, it sometimes fail to be recovered in its entirety. In other words, there is an optimal value for each of the biases for expelling toner particles from the charging member and for recovering the toner particles into the developing apparatus. Thus, the bias applied to expel toner particles from the charging member must be balanced relative to the bias applied to recover the expelled toner particles into the developing device. It is possible that there are optimal combinations between the values of the bias applied to the charge roller and the values of the bias applied to the developing apparatus. In consideration of this assumption, the amplitude of the bias applied to the charge roller to expel toner particles from the charge roller is set to 100 V (−620 V to −720 V), and in proportion to this amplitude, the amplitude of the bias applied to the developing apparatus to recover toner particles from the photoconductive drum (to clean photoconductive drum) is set to 1,300 V (+200 V to −1100 V).

Figure 3:
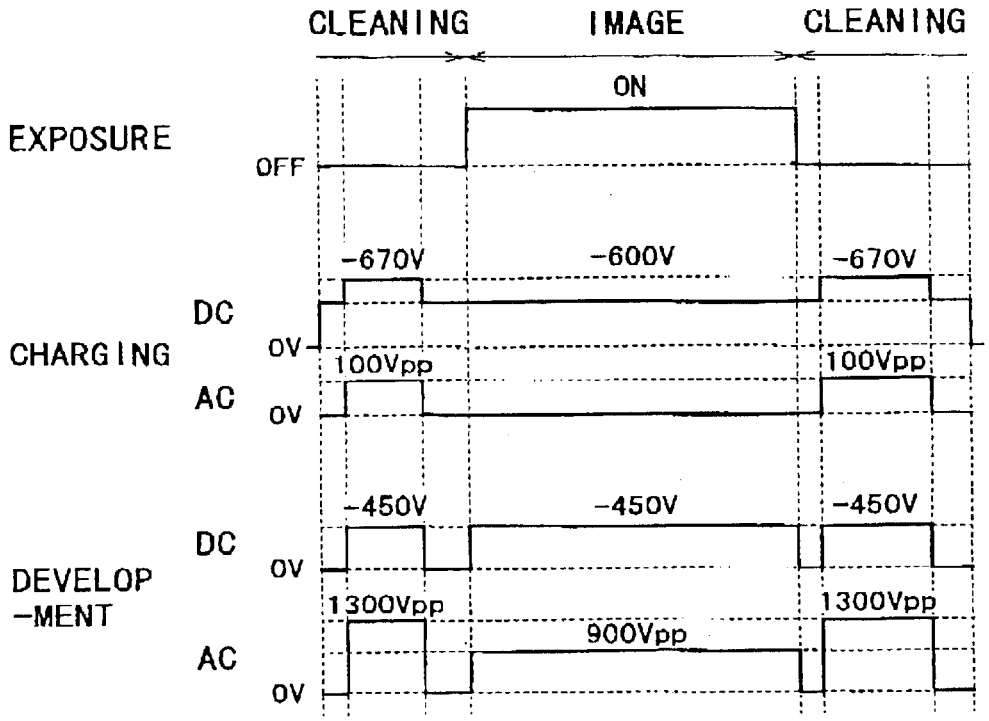
FIG. 3 is a drawing for showing the changes of the development bias and charge bias in the first embodiment of the present invention.
Figure 8:
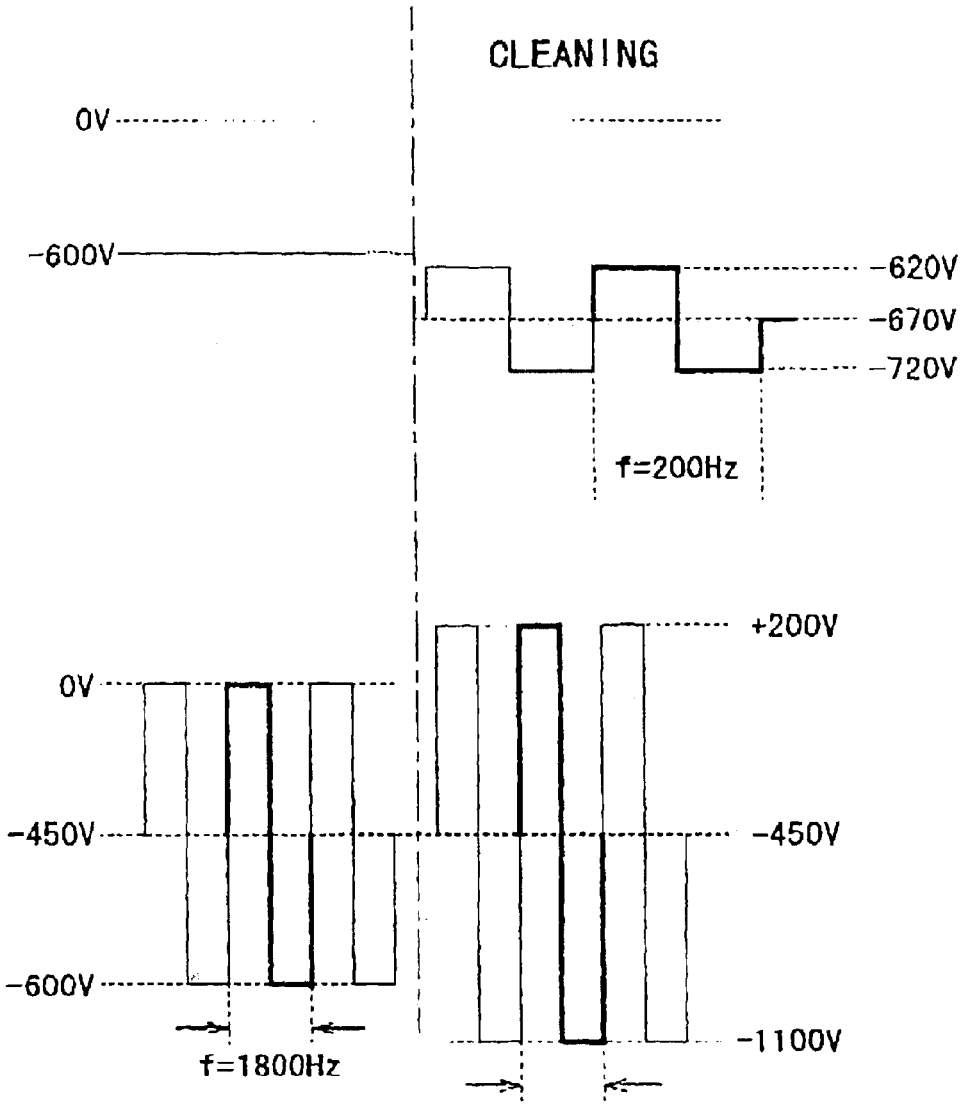
FIG. 8 is a drawing for showing the waveforms of the charge biases and development biases in the first and second embodiments.

FIG. 3 shows the changes of the development bias and charge bias in this embodiment. Further, Table 1 shows the values of the charge bias and development bias applied during the image forming operation, and during the cleaning operation. It should be noted here that in FIG. 3, the operational phases of the processes from the charging process to the developing process have been changed. FIG. 8 shows the waveforms of the charge bias and development bias during the image forming operation, and during the cleaning operation.

The switching between the charge bias and development bias during the image forming operation and during the cleaning operation is done by the power source selection switch 6*c* of the electric power source 6 for charge bias application, and the power source selection switch 8*c* of the electric power source 8 for development bias application, respectively, following unshown predetermined control sequence programs.

Referring to FIG. 3, as the operation of the image forming apparatus switches from image formation to cleaning, not only is an AC voltage such as the one shown in Table 1 is added to the charge bias, but also, the amplitude of the development bias is increased in coordination with the addition of the AC voltage to the charge bias. During the cleaning operation, a charge bias, which is rectangular in waveform, and 200 Hz in frequency, is applied, whereas during the cleaning operation and image forming operation, the development bias, which is rectangular in waveform and 1,800 Hz in frequency, is applied.

TABLE 1

| | | IMAGING | CLEANING |
|---|---|---|---|
| CHARGING BIAS | DC V (V) | −600 | −670 |
| | AC A (V) | 0 | −620 – −720 |
| | FREQ (Hz) | — | 200 |
| | WAVE | — | PLS WV |
| DEVELOPING BIAS | DC V (V) | −450 | −450 |
| | AC A (V) | 0 – −900 | +200 – −1100 |
| | FREQ (Hz) | 1800 | 1800 |
| | WAVE | PLS WV | PLS WV |

(1-5) Factors Used for Deciding Bias Properties in This Embodiment

The following conditions were taken into consideration when choosing the bias values and waveforms given in Table 1.

(1) Image Defect Traceable to Bias Leak

As high voltage is applied between the development roller and photoconductive drum, a bias leak sometimes occurs, adversely affecting the toner image on the photoconductive drum.

When the ambient pressure of the image forming apparatus in this embodiment was relatively low, in particular, when it was approximately 70 kPa, a bias leak occurred while printing solid black portions of an image, with the amplitude of the AC voltage as the development bias set at approximately 950 V.

Further, under the same condition, a bias leak occurred while printing solid white portions of an image, with the amplitude of the AC bias as the development bias set at approximately 1,350 V.

In consideration of the above facts, the amplitude of the AC voltage to be applied to the development roller during an image forming operation was set to 900 V, whereas the amplitude of the AC voltage to be applied to the development roller during a cleaning operation was set to 1,300 V, in order to output an optimal image.

(2) Toner Recovery Efficiency of Powder Pressure

As described previously, the higher the powder pressure, the better the efficiency with which the pre-existing toner particles on the photoconductive drum are recovered by the powder pressure. Further, the development bias is desired to have a rectangular waveform rather than a triangular or sinusoidal waveform; in other words, the development bias is desired to abruptly change in amplitude rather than to gradually change. Thus, in this embodiment, an AC voltage having a rectangular waveform was chosen as the development bias.

(1-6) Effects of First Embodiment

Figure 4:
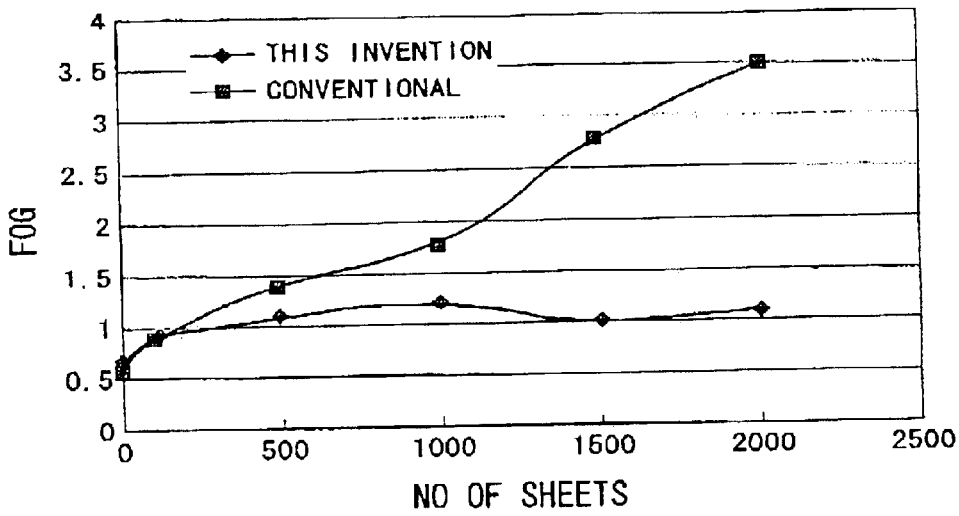
FIG. 4 is a drawing for showing the relationships between the number of the copies formed by the image forming apparatus in the first embodiment of the present invention and the resultant amount of fog, and the relationship between the number of the copies formed by an image forming apparatus in accordance with the prior arts and the resultant amount of fog.

FIG. 4 shows the relationship between the cumulative number of copies printed by the image forming apparatus in this embodiment, and the amount of fog, and the relationship between the cumulative number of copies printed by an image forming apparatus structured in accordance with the prior arts, and the amount of fog.

Here, being structured in accordance with the prior arts means that when the particle expulsion bias is applied to the charge roller, the development bias is not changed. In other words, it means that the development bias applied to recover toner particles from the photoconductive drum is the same as the development bias applied during the image forming operation.

Referring to FIG. 4, in the case of the image forming apparatus structured in accordance with the prior arts, the amount of the fog increases virtually In proportion to the cumulative number of copies printed by the apparatus. Also in the case of the image forming apparatus structured in accordance with the present invention, the amount of the fog increases as the cumulative number of copies printed by the apparatus increases, but the amount of the increase is very slight, being substantially smaller compared to the amount of the fog generated by the image forming apparatus structured in accordance with the prior arts.

The further evaluation of the images revealed that the images formed by the apparatus structured in accordance with the present invention were smaller in the amount of the continuity defects than those generated by the apparatus structured in accordance with the prior arts.

The differences between the image forming apparatus in this embodiment, and the image forming apparatus in accordance with the prior arts, in the above described experiments were studied, and the following observations were made.

With the increase in the cumulative number of copies, the transfer residual toner particles accumulate on the charge roller, and therefore, the amount of the toner particles expelled during a cleaning operation increases. The state of the peripheral surface of the photoconductive drum is roughly correspondent to the point B in FIG. 2. Therefore, if the amplitude of the AC voltage as the development bias is kept at 900 V, all the toner particles on the photoconductive drum cannot be recovered, increasing the amount of the post-development toner particles. As the cumulative number of copies further increases, the amount of the toner particles present on the photoconductive drum prior to each developing process also increases, further increasing the amount of the fog.

The application of the development bias superior in toner recovery efficiency, that is, the AC voltage With the amplitude of 1,300 V, during an image forming operation as well as a cleaning operation, makes it more likely for the above described bias leak to occur, and therefore, an image suffering from defects traceable to the above described bias leak is likely to be formed. Therefore, the AC voltage of 1,300 V should not be used during an image forming operation.

In comparison, in this embodiment, during an image forming operation, an AC bias, that is, a combination of a DC component of −450 V and an AC component of 900 V (Vpp=900 V) is used in order to prevent the occurrence of the bias leak. During a cleaning operation, however, an AC bias, that is, a combination of a DC component of −450 V and an AC component of 1,300 V (Vpp=1,300 V) is used. The use of the AC component of 1,300 V during a cleaning operation reduces the post-development fog compared to the use of the AC component of 900 V. This is due to the effect of the increased powder pressure. In other words, during a cleaning operation, the development bias is changed in coordination with the changing of the charge bias, in order to minimize the amount by which toner particles remain on the photoconductive drum, in the range on the immediately downstream side of the development location, in terms of the rotational direction of the photoconductive drum, by enhancing the toner recovery performance in proportion to the amount by which toner particles are expelled during the cleaning operation. As a result, the amount of the post-development fog is minimized while assuring image quality. Thus, even if the cumulative number of the copies formed by the image forming apparatus is substantial, the fog is not likely to occur. Further, the minimization of the amount of the toner particles present on the photoconductive drum, on the upstream side of the developing location, means the minimization of the amount of the toner particles between the peripheral surfaces of the charge roller and photoconductive drum. Thus, the image forming apparatus in this embodiment could form images, the continuity defects of which traceable to the above described unsatisfactory charging of the photoconductive drum are substantially fewer and smaller in magnitude compared to those of the images formed by the image forming apparatus structured in accordance with the prior arts. In other words, the image forming apparatus in this embodiment could repeatedly and continuously provide high quality images.

(1-7) Embodiment 1-2

Figure 12:
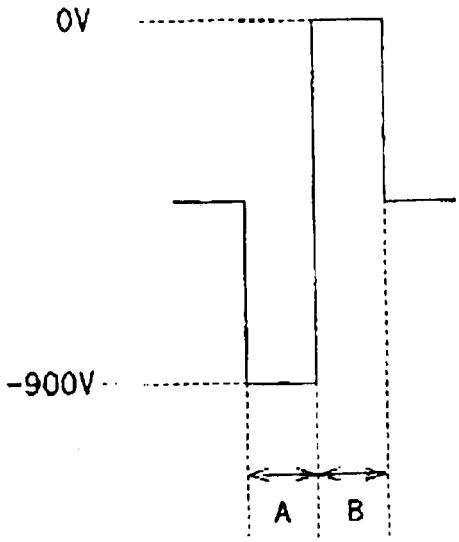
FIG. 12 is a drawing for showing the duty ratio of the development bias.

In the case of this embodiment, the image defects such as fog and discontinuity, could be reduced by substantially changing the amplitude of the AC component of the development bias, in coordination with the changing of the toner expulsion bias, in other words, by enhancing the powder pressure. According to the experiments carried out by the inventors of the present invention, the occurrences of the fog, discontinuity, light blockage blemish, etc., could be reduced by increasing powder pressure by changing the integral average value (duty ratio: A/(A+B)×100 (%), FIG. 12), and frequency, in addition to amplitude, of the AC component of the development voltage.

Figure 9:
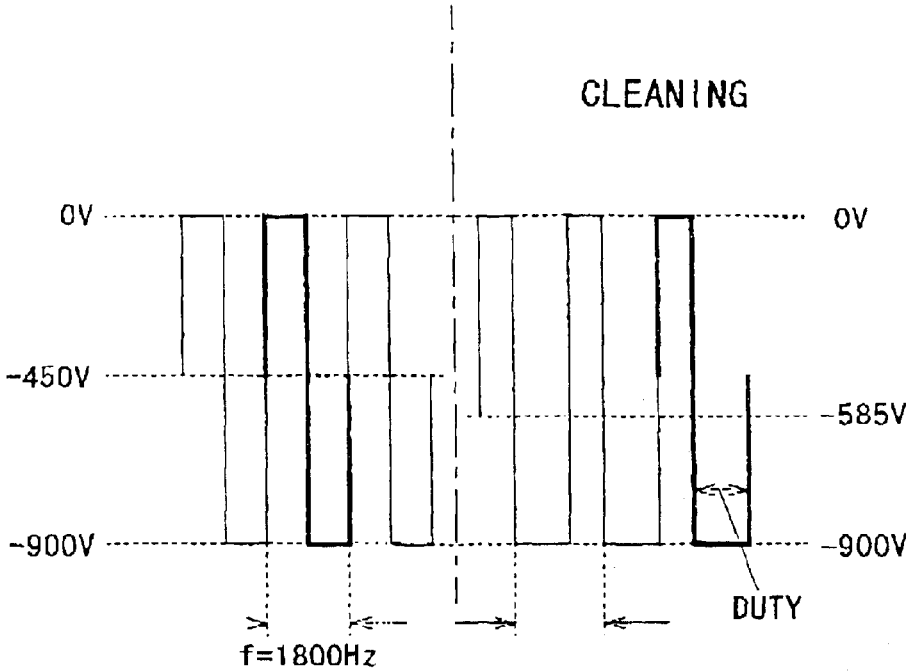
FIG. 9 is a drawing for showing the waveforms of the development biases in Embodiments 1-2 and 2-2.
Figure 10:
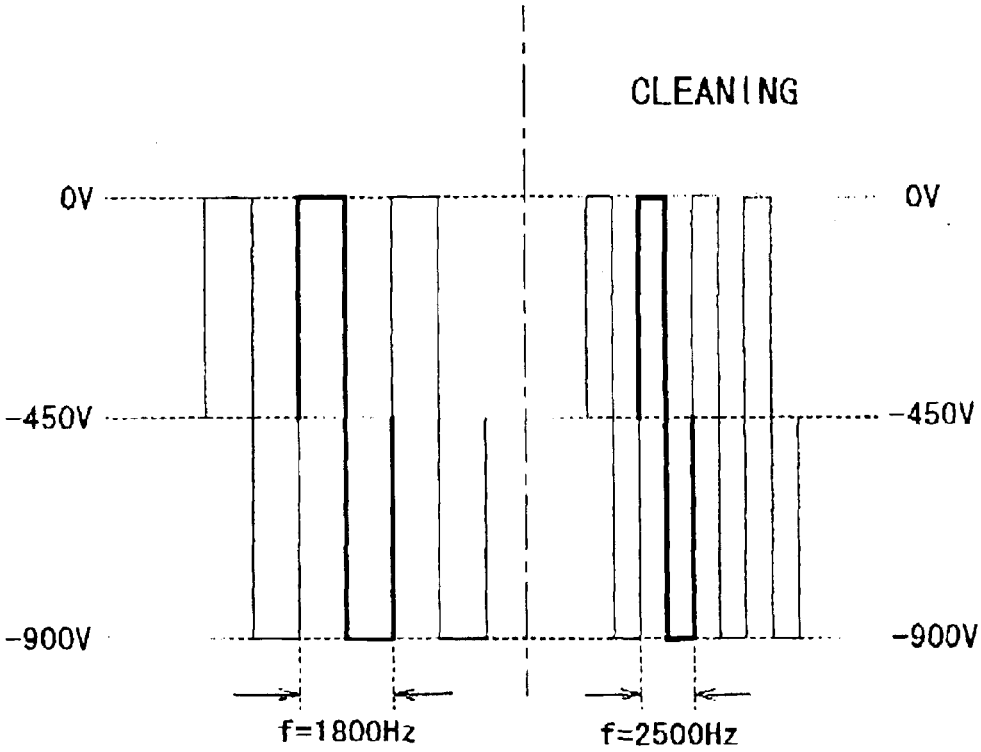
FIG. 10 is a drawing for showing the waveforms of the development biases in Embodiments 1-3 and 2-3.

More specifically, during a cleaning operation, the duty ratio of the development voltage was increased in coordination with the changing of the particle expulsion bias in order to increase the powder pressure as a result, the amount of the image defects such as fog, light blockage blemish, etc., was smaller. Table 2 given below shows the bias values in Embodiment 1-2. Further, the bias waveforms during the image formation operations and cleaning operations are shown in FIG. 9. As will be evident from Table 2 and FIG. 9, the duty ratio of the bias applied to the development roller during cleaning was increased from 50%, which was the duty ratio during image formation, to 65%. In other words, during cleaning, the ratio of the period through which the bias effects the movement of the toner particle from the development roller to photoconductive drum is increased compared to that during image formation.

TABLE 2

| | | IMAGING | CLEANING |
|---|---|---|---|
| CHARGING BIAS | DC V (V) | −600 | −670 |
| | AC A (V) | — | −620 – −720 |
| | DUTY (%) | — | 50 |
| | FREQ (Hz) | — | 200 |
| | WAVE | — | PLS WV |
| DEVELOPING BIAS | DC V (V) | −450 | −585 |
| | AC A (V) | 0 – −900 | 0 – −900 |
| | DUTY (%) | 50 | 65 |
| | FREQ (Hz) | 1800 | 1800 |
| | WAVE | PLS WV | PLS WV |

(1-8) Embodiment 1-3

In this embodiment, during cleaning, the frequency of the voltage applied for development was increased in coordination with the changing of the particle expulsion bias. As a result, the occurrences of the image defects, for example, fog, light blockage blemish, etc., were reduced. Table 3 given below shows the bias values in Embodiment 1-3. Further, FIG. 9 shows the bias waveforms during image formation and cleaning.

TABLE 3

| | | IMAGING | CLEANING |
|---|---|---|---|
| CHARGING BIAS | DC V (V) | −600 | −670 |
| | AC A (V) | — | −620 – −720 |
| | DUTY (%) | — | 50 |
| | FREQ (Hz)( | — | 200 |
| | WAVE | — | PLS WV |
| DEVELOPING BIAS | DC V (V) | −450 | −450 |
| | AC A (V) | 0 – −900 | 0 – −900 |
| | DUTY (%) | 50 | 50 |
| | FREQ (Hz) | 1800 | 2500 |
| | WAVE | PLS WV | PLS WV |

(1-9) Embodiment 1-4

Figure 11:
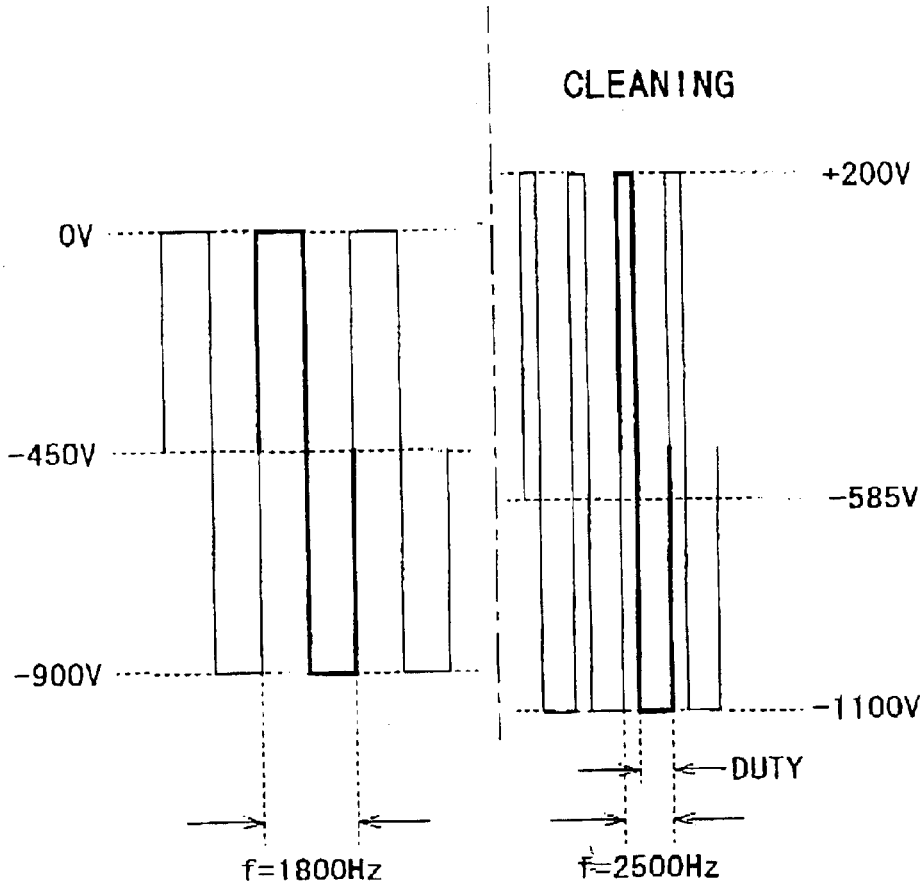
FIG. 11 is a drawing for showing the waveforms of the development biases in Embodiments 1-4 and 2-4.

The amplitude, duty ratio, and frequency, that is, the changeable properties of the development bias, were all increased in coordination with the changing of the particle expulsion charge bias. As a result, the occurrences of the fog, light blockage blemish, and discontinuity, were further reduced. Table 4 given below shows the bias values in Embodiment 1-4. Further, FIG. 11 shows the bias waveforms during image formation and cleaning.

TABLE 4

| | | IMAGING | CLEANING |
|---|---|---|---|
| CHARGING BIAS | DC V (V) | −600 | −670 |
| | AC A (V) | — | −620 – −720 |
| | DUTY (%) | — | 50 |
| | FREQ (Hz) | — | 200 |
| | WAVE | — | PLS WV |
| DEVELOPING BIAS | DC V (V) | −450 | −585 |
| | AC A (V) | 0 – −900 | +200 – −1100 |
| | DUTY (%) | 50 | 65 |
| | FREQ (Hz) | 1800 | 2500 |
| | WAVE | PLS WV | PLS WV |

(Embodiment 2)

Figure 5:
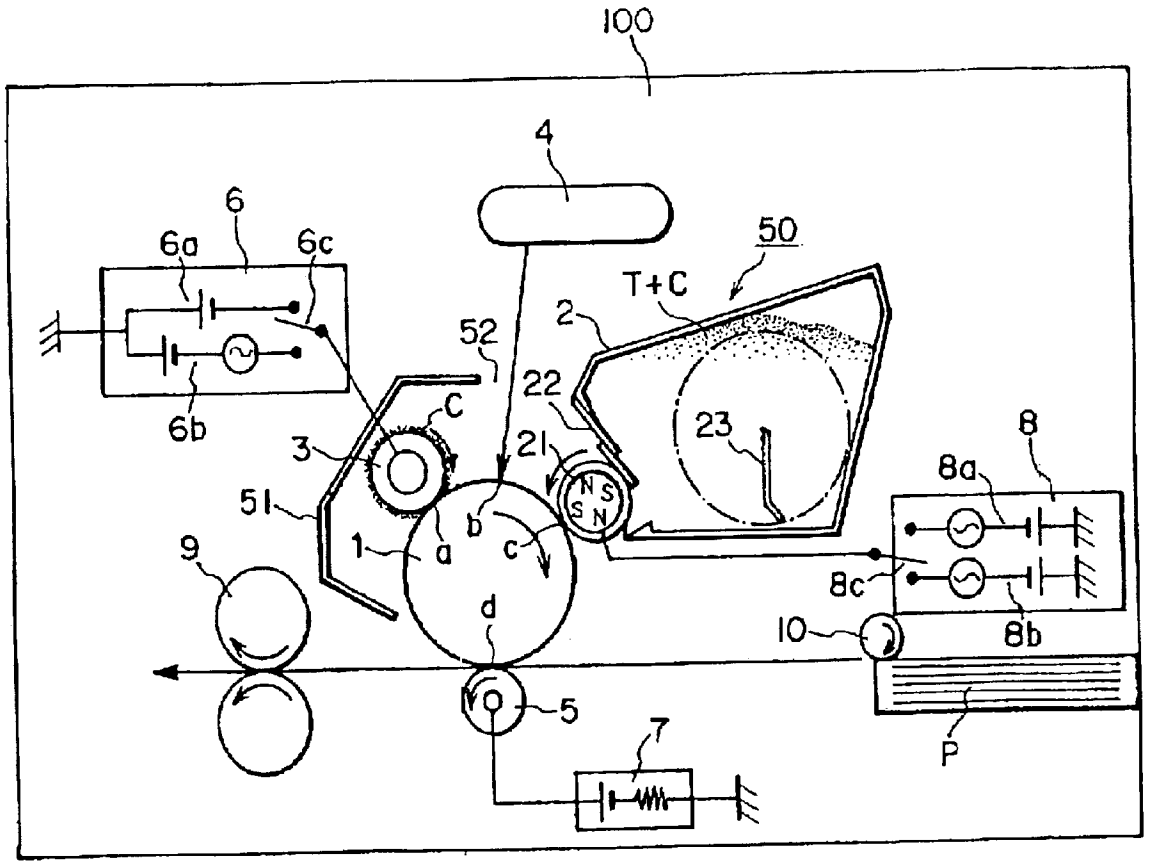
FIG. 5 is a drawing for describing the structure of the image forming apparatus in the second embodiment of the present invention.

FIG. 5 is a drawing showing the general structure of the image forming apparatus in this embodiment The image forming apparatus in this embodiment is different from the image forming apparatus in the first embodiment (FIG. 1) in that a mixture, at a predetermined ratio, of toner T and electrically conductive particles C (opposite in charge polarity to toner) is used as the developer for the developing apparatus 2. Otherwise, this image forming apparatus is identical to the image forming apparatus in the first embodiment. Thus, the component, member, portions, etc., of this image forming apparatus, which are the same in function as those in the image forming apparatus in the first embodiment, are given the same referential symbols as those given to those in the first embodiment, and will not be described here.

In this second embodiment, during the development of an electrostatic latent image, the electrically conductive particles among the toner particles T adhere, along with the toner particles, to the peripheral surface of the photoconductive drum 1. Then, as the photoconductive drum 1 is rotated, they are conveyed through the transfer nip d, and then, to the charge nip a. In the charge nip a, they are captured by the peripheral surface of the charge roller 3; they are supplied to the peripheral surface of the charge roller 3. Then, the electrically conductive particles on the peripheral surface of the charge roller 3 function as charging performance enhancing agent, in the nip between the charge roller 3 and photoconductive drum 1, keeping stable the photoconductive drum charging mechanism of the image forming apparatus of a cleaner-less type, even after a substantial number of repetitions of the image forming operations.

The structure and operation of the image forming apparatus in this embodiment are identical to those of the image forming apparatus in the first embodiment, and therefore, they will not be described here. Next, the photoconductive drum, charge roller, and electrically conductive particles used in this second embodiment will be described.

(2-1) Photoconductive Drum 1

The photoconductive drum 1 is an organic photoconductive drum, and comprises an aluminum drum as a substrate, the same three functional layers, that is, the undercoat layer, charge generation layer, and charge transfer layer, as those in the first embodiment, and an additional functional layer, that is, a charge injection layer, which is coated in layers on the charge transfer layer to improve the chargeability of the photoconductive drum 1

(2-2) Charge Roller 3

The charger roller 3, as a contact type charging member, is a roller comprising a metallic core, and a layer of foamed substance coated on the entirety of the peripheral surface of the metallic core in a manner to form a roller coaxial with the metallic core. The electrical resistance of the foamed substance is in a range of $10^4$–$10^7$ Ω·cm. Prior to the literal first usage of the image forming apparatus, the charge roller 3 is coated with a 0.2 g of electrically conductive particles The charge roller 3 is rotationally driven in such a direction that the peripheral surface of the charge roller 3 moves in the direction counter to the moving direction of the peripheral surface of the photoconductive drum 1, in the charging nip a, providing thereby the charge roller 3 with a differential peripheral velocity of 150% relative to the peripheral surface of the photoconductive drum 1.

(2-3) Electrically Conductive Particles C

In this embodiment, zinc oxide is used as the material for the electrically conductive particles C. However, one of metallic oxides other than zinc oxide may be used as the material for the electrically conductive particles C. Electrical charge is exchanged through these electrically conductive particles. Therefore, their resistivity is made to be $10^6$ Ω·cm, and their average particle diameter is made to be 3 μm.

The charging performance enhancement characteristics of the electrically conductive particles C are measured using the following method. A mixture of 9 g of fluorinated resin particles and 1 g of electrically conductive particles are placed in a test tube, and the test tube is shaken roughly 30 times to charge the electrically conductive particles. Then, the amount of the electrical charge acquired by the electrically conductive particles is measured. The same process is carried out for the mixture of toner particles and fluorinated resin particles to measure the amount of the electrical charge acquired by the toner particles, and also to check the polarity of the electrical charge of the toner particles. The electrically conductive particles in this embodiment showed a tendency to be charged to the polarity opposite to that of the toner particles.

Thus, as a combination of a DC component of −450 V and an AC component of 900 V (Vpp =900 V) is applied as the development bias, the electrically conductive particles in the developer, which are not adhering to the toner particles, jump from the development roller 21 onto the points of the peripheral surface of the photoconductive drum 1, corresponding to the background portions (potential level Vd=−600 V) of an image being formed, since there is a contrast of 600 V (|Vmin−Vd|=(|0−(−800)|)). However, the electrically conductive particles adhering to the toner particles T jump from the development roller 21 to the exposed points (potential level V1=−170 V) of the peripheral surface of the photoconductive drum 1, since there is a contrast of 730 V (|Vmax−V1|=(|−900−(−170)|)).

The electrically conductive particles C having jumped onto the photoconductive drum 1 are opposite in polarity to the toner particles. Therefore, they remain on the photoconductive drum 1, along with the transfer residual toner particles, after the transfer process. Then, the majority of them are picked up by the peripheral surface of the charge roller 3, in the charge nip in which the peripheral surface of the charge roller 3 is moving in the direction opposite to the moving direction of the peripheral surface of the photoconductive drum 1. Therefore, even though the supply of electrically conductive particles C having been coated on the charge roller 3 prior to literally the first usage of the image forming apparatus reduces due to the repetition of various image forming operations, a fresh supply of the electrically conductive particles is supplied from within the developing apparatus 2, maintaining the chargeability of the photoconductive drum 1 at a preferable level. Incidentally, even if the electrically conductive particles are not opposite in polarity to the toner particle, as long as the amount of the electrical charge acquired by the electrically conductive particles is extremely small compared to the electrical charge acquired by the toner particles, they are not transferred onto the transfer medium; in other words, they remain on the photoconductive drum 1 and are picked up by the charge roller 2, contributing to the charging of the photoconductive drum 1 by the charge roller 2.

The operation of the image forming apparatus in this second embodiment of the present invention, and the voltage values related thereto, are the same as those in the first embodiment.

(2-4) Embodiment 2-1

This is one of the modifications of the second embodiment, in which the amplitude of the AC component of the development bias is increased in synchronism with the application of the particle expulsion bias to the charge roller 3. The bias values are the same as those given in table 1.

As described above, there are toner particles and electrically conductive particles, in the mixed state, in and on the charge roller 3. Therefore, as the particle expulsion bias is applied to the charge roller 3, the toner particles and electrically conductive particles are expelled together onto the photoconductive drum 1, creating sometimes such a condition that the amount of the electrically conductive particles necessary, in the nip between the charge roller 3 and photoconductive drum 1, for enhancing the chargeability of the photoconductive drum 1, is not sufficient for creating a preferable environment for charging the photoconductive drum 1.

Thus, the amplitude of the AC component of the development bias is increased to enhance the toner recovery performance while increasing the amount by which the electrically conductive particles are supplied. As a result, the electrically conductive particles are supplied to the nip between the charge roller 3 and photoconductive drum 1, by the amount sufficient to maintain the charging efficiency at a preferable level.

During a cleaning operation, the value of the amplitude of the AC component of the development bias is desired to be in a range of 0.8× Vover to 0.99× Vover, wherein Vover stands for the leak threshold value of the amplitude of the AC component of the development bias.

(2-5) Embodiment 2-2

Next, another modification of the second embodiment, in which the integral average value (duty ratio) of the development bias is changed in synchronism with the application of the particle expulsion bias to the charge roller 3, will be described. The bias values are the same as those given in Table 2.

Also as described above, the toner particles are negative in polarity, whereas the electrically conductive particles are positive in polarity. Therefore, in terms of the charging performance enhancement, the mixture of the toner particles and electrically conductive particles is inferior to the toner particles alone. Thus, while the particle expulsion bias is applied to the charge roller, the mixture of the toner particles and electrically conductive particles is less efficiently recovered into the developing device than the toner particles alone. Therefore, in this embodiment, the value of the integral average of the portion of the development bias, which effects the particles to jump from the photoconductive drum onto the development roller, is changed so that the length of time during which the toner particles on the developing device side jump onto the photoconductive drum becomes longer. As a result, the mixture of the toner particles and electrically conductive particles on the photoconductive drum is more efficiently recovered. This seemed to occur because the toner particles having jumped from the development roller onto the photoconductive drum jumped back to the developing device side, bringing along the toner particles and electrically conductive particles pre-existing on the photoconductive drum.

This modification of the second embodiment is particularly effective when applied to an image forming apparatus, such as the above described one, the developing device of which is supplied with a mixture of toner particles and electrically conductive particles.

The image forming apparatus in the first embodiment of the present invention is an image forming apparatus which uses toner particles alone. In the case of this image forming apparatus in the first embodiment, the ratio at which the developer is recovered when the value of the integral average of the AC component of the development bias was changed was 1.2 times that when the value of the integral average of the AC component of the development bias was not changed. In comparison, in the case of the image forming apparatus in this second embodiment, which uses a mixture of toner particles and electrically conductive particles as developer, the ratio at which the developer is recovered when the value of the integral average of the AC component of the development bias was changed was 2.2 times that when the value of the integral average of the AC component of the development bias was not changed.

It is desired that the duty ratio is adjusted so that the value of the integral average Vdc of the AC component of the development bias falls within a range of $0\ V<|Vd-Vdc|\leqq 250\ V$, wherein Vd stands for the potential level of the unexposed points of the peripheral surface of the photoconductive drum 1. If $|Vd-Vdc|>250\ V$, the potential level difference which effects the toner particles on the development roller to jump onto the photoconductive drum is smaller, and therefore, the amount of the reciprocal movement of the toner particles between the development roller and photoconductive drum is smaller. Thus, there is a possibility that the residual toner particles on the photoconductive drum will not be recovered into the developing means container by a sufficient amount. Moreover, if $|Vd-Vdc|>250\ V$, the potential level difference which effects the electrically conductive particles on the development roller to jump onto the photoconductive drum is greater, causing the electrically conductive particles in the developing means container to be supplied to the photoconductive drum by an excessive amount. Therefore, there is a possibility that the developing means container will run short of the electrically conductive particles, causing the photoconductive drum to be insufficiently charged. This is why the value of the integral average Vdc of the AC component of the development bias is desired to be in the range in which $0\ V<|Vd-Vdc|\leqq 250\ V$.

(2-6) Embodiment 2-3

In this embodiment, the frequency of the development bias was changed in synchronism with the application of the particle expulsion bias to the charge roller. The bias values are the same as those given in Table 3.

Most of the toner particles T and electrically conductive particles C, on the development roller 21 jump the moment the voltage being applied is switched in polarity. Thus, the efficiency with which the toner particles on the photoconductive drum are recovered into the developing apparatus can be improved by increasing the frequency at which the toner particles and electrically conductive particles jump so that the frequency, at which those particles jump, increases. However, when the frequency is higher than a certain value, the toner particles in their flight from the development roller to the peripheral surface of the photoconductive drum are pulled back onto the development roller before they reach the peripheral surface of the photoconductive drum, and therefore, the amount of the reciprocal movement of the toner particles between the development roller and photoconductive drum is smaller. Therefore, there is a possibility that the residual toner particles on the photoconductive drum will not be recovered by a sufficient amount. In order to minimize this problem, it is desired that the development bias frequency is changed in a manner to satisfy the following mathematical relationship between a development bias frequency f1, at which images of good quality can be formed, and development bias frequency f2, at which the photoconductive drum is efficiently cleaned: $1.0\times f1<f2\leqq 1.5\times f1$. Further, simply changing the frequency of the development bias from f1 to f2 as the operation of the image forming apparatus switches from an image forming process to a cleaning process makes it possible to use the same high voltage circuit chip for the clearing process as well as the development process, preventing thereby the cost increase which otherwise would have occurred.

(2-7) Embodiment 2-4

In this embodiment, all of the above described variable changeable properties of the development bias, that is, the amplitude, duty ratio, and frequency, were changed in synchronism with the application of the particle expulsion bias to the charge roller. As a result, the frequency of the occurrences of the fog, light blockage blemish, and image discontinuity, is much smaller. The bias values were same as those in Table 4.

The electrically conductive particles having the above described characteristics are desired to be opposite, in the polarity to which they become charged, to that of the toner particles, $10^{-1}$ Ω·cm–$10^{9}$ Ω·cm in electrical resistance, and 0.5 μm–10 μm in weight average diameter.

COMPARATIVE EXAMPLES OF IMAGE FORMING APPARATUS NONCONFORMING IN STRUCTURE TO PRESENT INVENTION

The image forming apparatuses in the following comparative examples are the same as the one in the first embodiment, and also, their development bias sequences are the same as that in accordance with the prior arts. The numbering of the following comparative examples corresponds to that of the above described embodiments.

Comparative Example 1

During the cleaning process, the particle expulsion bias was applied, but no change was made to the development bias

Comparative Example 2

During the cleaning process, the particle expulsion bias (from −620 V to −720 V) was charged, but no change was made to the development bias.

Comparative Example 3

During the cleaning process, the particle expulsion bias was not charged, and a change was made to the development bias (amplitude of AC component of development bias was increased from 900 V to 1,300 V).

(Embodiment 1)

During the cleaning process, the developer recovery bias was changed (AC component amplitude was increased from 900 V to 1,300), in synchronism with the application of the particle expulsion bias (from −620 V to −720 V).

(Embodiment 1-2)

During the cleaning process, the developer recovery bias was changed (duty ratio was increased from 50% to 65%), in synchronism with the application of the particles expulsion bias (from −620 V to −720V)

(Embodiment 1-3)

During the cleaning process, the developer recovery bias was changed (AC component frequency was increased from 1,000 Hz to 2,500 Hz), in synchronism with the application of the particle expulsion bias (from −620 V to −720 V).

(Embodiment 1-4)

During the cleaning process, the developer recovery bias was changed (AC component amplitude was increased from 900 V to 1,300 V; duty ratio was increased from 50% to 65%; and AC component frequency was increased from 1,800 Hz to 2,500 Hz), in synchronism with the application of the particle expulsion bias (from −620 V to −720V).

(Embodiment 2-1)

During the cleaning process carried out by an image forming apparatus using developer containing electrically conductive particles, the developer recovery bias was changed (AC component amplitude was increased from 900 V to 1,300 V), in synchronism with the application of the particle expulsion bias (from −600 V to −720 V).

(Embodiment 2-2)

During the cleaning process carried out by an image forming apparatus using developer containing electrically conductive particles, the developer recovery bias was changed (duty ratio was increased from 50% to 65%), in synchronism with the application of the particle expulsion bias (from −600 V to −720 V).

(Embodiment 2-3)

During the cleaning process carried out by an image forming apparatus using developer containing electrically conductive particles, the developer recovery bias was changed (AC component frequency was increased from 1,800 Hz to 2,500 Hz), in synchronism with the application of the particle expulsion bias (from −600 V to −720 V)

(Embodiment 2-4)

During the cleaning process carried out by an image forming apparatus using developer containing electrically conductive particles, the developer recovery bias was changed (AC component amplitude was increased from 900 V to 1,300 V; duty ratio was increased from 50% to 65%; and AC component frequency was increased from 1,800Hz to 2,500 Hz), in synchronism with the application of the particle expulsion bias (from −600 V to −720 V).

(Results of Comparison Tests)

Test Method: a sample image was evaluated after printing 2,000 copies, which were 4% in print ratio, in an environment in which the room temperature was 32.5° C., and the humidity was 80%.

1: Fog (On Recording Paper) Evaluation

Fog is an image defect which occurs as the toner particles having adhered to the unexposed points of the peripheral surface of the photoconductive drum 1 (corresponding to white areas of original) are transferred onto a recording paper, and which causes the recording paper to look as if it were soiled prior to image transfer. As for the measurement of the amount of the fog, the optical reflectivity of the sample image was measured with the use of the previously described Densitometer TC-6DS along with a green filter, and the difference between the reflectivity of the paper itself and the reflectivity of the sample image was deemed as the amount of the fog. The reflectivity of the paper was obtained as the average value of the measured reflectivities of no less than 10 points on the paper.

E: no more than 1%

G: 1%–3%

F: 3%–5%

N: no less than 5%

2: Light Blockage Blemish Evaluation

A light blockage blemish is an image defect resulting from the presence of a large amount of particles such as toner particles. More specifically, if a large amount of particles is on a given area of the portion of the peripheral surface of a photoconductive drum, on the downstream side of the charge roller in terms of the moving direction of the peripheral surface of the photoconductive drum, the exposure light is blocked by the particles. As a result, the portion of an intended image, corresponding to the given area of the photoconductive drum, is not formed; in other words, an image having a blemish traceable to the exposure light blockage is formed.

The amount of the light blockage blemish was visually evaluated.

E: invisible

G: slightly visible or virtually invisible

F: fairly visible

N: very visible.

3: Image Discontinuity

In spite of the application of the particle expulsion bias to the charging member, not all the toner particles having been taken into the charging roller are expelled. Therefore, while an image forming operation is repeated, the transfer residual toner particles gradually accumulates in and on the charging member. Generally, the toner particles are electrically insulating. Therefore, the presence of the toner particles in the nip between the charging member and photoconductive drum interferes with the charging of the peripheral surface of the photoconductive drum, resulting in the formation of a discontinuous toner image on the peripheral surface of the photoconductive drum. This is the image defect called discontinuity defect, which is very likely to occur as the amount of the transfer residual toner particles in or on the charging member becomes substantial.

The discontinuity defect was visually evaluated based on a halftone sample image consisting of a plurality of horizontal dotted lines with double spaces.

E: invisible

G: visible but inconspicuous

F: visible and conspicuous

N: visible and very conspicuous

The results of the tests are given in the following Table 5.

TABLE 5

| | IMAGE ASSESSMENT | | |
|---|---|---|---|
| | FOG ON SHEET | LIGHT BLOCK | NON-UNIFORMITY |
| COMP. EX. 1 | N | N | N |
| COMP. EX. 2 | F | N | N |
| COMP. EX. 3 | N | F | N |
| EMB. 1 | G | G | F |
| EMB. 1-2 | G | F | F |
| EMB. 1-3 | F | F | F |
| EMB. 1-4 | G | E | F |
| EMB. 2-1 | G | G | E |
| EMB. 2-2 | E | G | G |
| EMB. 2-3 | G | G | G |
| EMB. 2-4 | E | E | E |

In the case of Comparative Examples 1, 2, and 3, after the printing of roughly 500 copies, the contamination of the charging member by toner particles became conspicuous, and the discontinuity and fog also became somewhat conspicuous. Then, after the printing of roughly 2,000 copies, the image defects were fairly conspicuous.

In the case of Embodiments 1, 1-2, and 1-3, the contamination of the charging member was conspicuous, but the resultant image defects were less than those in the case of the comparative examples.

In the case of Embodiment 1-4, the effects of the present invention were fairly evident as far as the fog and light blockage blemish are concerned.

In the case of Embodiments 2-1–2-4, in which the electrically conductive particles were employed, the amount of the discontinuity defects was smaller than those in Embodiments 1-1–1-4. Further, in the case of Embodiment 2-4, the amounts of all of the above described image defects were smaller.

(Miscellaneous Embodiments)

1) In the case of the preceding embodiments, the period through which the charge bias is applied between the charging member and photoconductive drum during the cleaning operation, and the period through which the development bias is applied between the developing member and photoconductive drum during the cleaning operation, overlap 100%. However, as long as the period, in which one or all of the aforementioned variable properties of the development bias are at their enhanced particle recovery levels, overlaps the period through which the charge bias is at the enhanced particle recovery levels, the fog and light blockage blemish are reduced. This will be described next with reference to FIG. 6.

Figure 6:
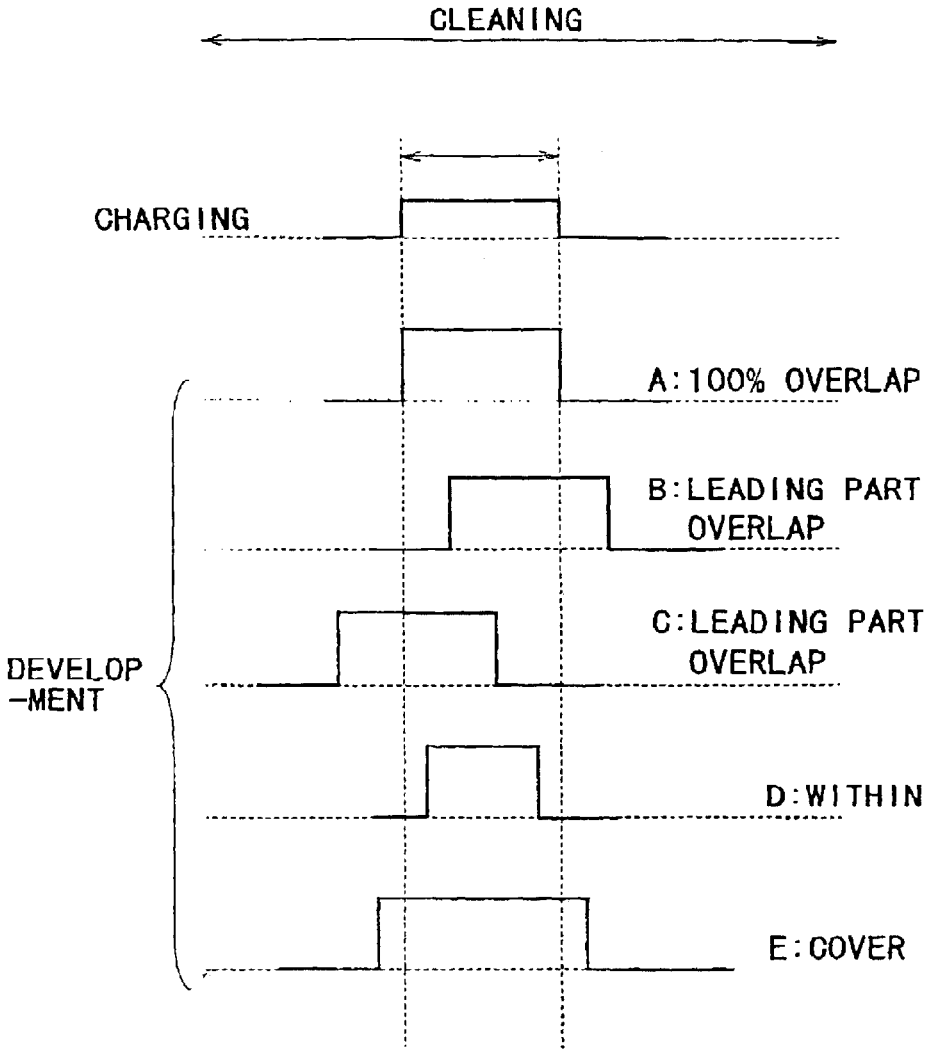
FIG. 6 is a drawing for showing the patterns of the altered portions of the charge bias and development bias, in this embodiment of the present invention.

FIG. 6 shows the relationship between the period through which the charge bias is kept at the altered level, and the period through which the development bias is kept at the altered level.

The line designated by a referential character A represents the above described embodiments in which the period through which the development bias is kept at the altered level overlaps 100% the period through which the charge bias is kept at the altered level.

The line B represents the case in which the front half of the period through which the development bias is kept at the altered level overlaps the period through which the charge bias is kept at the altered level, whereas the line C represents the case in which the latter half of the period through which the development bias is kept at the altered level overlaps the period through which the charge bias is kept at the altered level.

The line D represents the case in which the period during which the development bias is kept at the altered level falls within the period through which the charge bias is kept at the altered level.

The line E represents the case in which the period through which the charge bias is kept at the altered level falls within the period through which the development bias is kept at the altered level.

In all of the above described five cases, the same effects as those obtained in the above described embodiments were obtained.

In the cases represented by lines B–D, the effects of the present invention were evident when 30% or more of the period through which the development bias was kept at the altered level overlapped the period through which the charge bias was kept at the altered level. However, it is desired that 50% or more of the period through which the development bias is kept at the altered level overlaps the period through which the charge bias is kept at the altered level. In the case represented by the line E, the fog was sometimes generated during the period, in which the period through which the development bias was kept at the altered level did not overlap the period through which the charge bias was kept at the altered level. Therefore, in the case represented by the line E, it is desired that the length of the period through which the development bias is kept at the altered level is no more than 150% of the length of the period through which the charge bias is kept at the altered level.

2) The charging member does not need to be in the form of a roller as are those in the preceding embodiments, and the charging method does not need to be of a contact type. In other words, even in the case of an image forming apparatus employing a brush, a blade, or the like, as a charging member, and also employing a noncontact type charging method, as long as it is structured so that during the cleaning period, the charge bias is altered to return particles, such as toner particles, having accumulated in and on the charging member, the same effects as those of the preceding embodiments can be obtained by altering the development bias in coordination with the alteration of the charge bias.

3) The exposing means for forming an electrostatic latent image does not need to be limited to a scanning laser beam type exposing means, such as those in the preceding embodiment, which forms a digital latent image. For example, it may be an ordinary analog image exposing means, an LED, a combination of a light emitting element, such as a fluorescent light, and a liquid crystal shutter, etc. In other words, any exposing means will suffice, as long as it is capable of forming an electrostatic latent image in accordance with image forming information.

4) The image bearing means may be an electrostatic recordable dielectric member, or the like. When it is an electrical recordable dielectric member, first, its surface is uniformly charged to predetermined polarity and potential level, and the numerous points of the uniformly charged surface are selectively discharged with the use of a charge removing means, for example, an electron gun or the like, to write an electrostatic latent image of an original.

5) The transferring means does not need to be limited to a transferring means employing a transfer roller. For example, it may be a transferring means employing a transfer belt, a corona discharging device, or the like. Further, the present invention is also applicable to an image forming apparatus which employs an intermediary transfer number (intermediary transfer medium), for example, a transfer drum, a transfer belt, or the like, and which is capable of forming not only a monochromatic image but also a multicolor image or a full-color image, with the use of a multilayer transfer process or the like.

6) In the case of a direct charge injection mechanism, electrical charge is directly transferred from a contact type charging member to the portion of a member to be charged. Therefore, it must be assured that the contact type charging member is directly in contact with the member to be charged. Further, it is desired that the contact type charging member is rotated with the presence of peripheral velocity difference between the contact type charging member and member to be charged. As for an example of the means for providing the peripheral velocity difference, the contact type charging member is driven so that its surface moves relative to the surface of the member to be charged. Preferably, the contact type charging member is rotationally driven, and also that the direction in which it is rotationally driven is such that the direction in which the surface of the member to be charged moves in the charging nip is opposite to the moving direction of the peripheral surface of the contact type charging member in the charging nip. It is possible to provide peripheral velocity difference between the peripheral surfaces of the contact type charging member and member to be charged, while moving the two peripheral surfaces in the same direction. However, the charging efficiency of the direct charge injection mechanism is dependent on the ratio between the peripheral velocities of the member to be charged and contact type charging member. Therefore, in order to obtain the same peripheral velocity ratio as that obtained by moving the two peripheral surfaces in the opposite direction, by moving the two peripheral surfaces in the same direction, the revolution of the contact type charging member must be substantially greater than that when the two peripheral surfaces are moved in the opposite direction. Thus, moving the peripheral surfaces of the contact type charging member and member to be charged in the opposite direction is advantageous in terms of the revolution of the contact type charging member. Here, the definition of the peripheral velocity ratio is as follows: peripheral velocity ratio (%)=(peripheral velocity of contact type charging member−peripheral velocity of member to be charged)/peripheral velocity of member to be charged×100 (peripheral velocity of contact type charging member is assumed to be positive when peripheral surface of contact type charging member moves in the same direction as peripheral surface of member to be charged, in contact area between contact type charging member and member to be charged).

7) The waveform of the alternating component of the voltage (AC component: voltage which periodically alters in value) applied, as bias, to a charging member or a developer bearing member is optional. For example, it may be sinusoidal, rectangular, or triangular. Further, the rectangular waveform may be generated by periodically turning on and off a DC power source. The means for generating the alternating waveform does not need to be limited to the above described combination of a DC power source and an AC power source. In other words, the alternating current may be generated with the use of only a DC power source.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image forming means;

an image bearing member for bearing an electrostatic latent image formed thereon by said image forming means;

a charging member for electrically charging said image bearing member;

developing means for developing with a developer the electrostatic latent image formed on said image bearing member, said developing means including a developer carrying member for carrying the developer, wherein a gap is formed between said developer carrying member and said image bearing member; and bias voltage applying means for applying a bias voltage to said developer carrying member, wherein said bias voltage applying means applies an AC bias voltage when the electrostatic latent image is developed, wherein said developing means is capable of collecting the developer from said image bearing member, and a peak-to-peak voltage of an AC bias voltage applied to said developer carrying member by said bias voltage applying means when the developer is collected and the electrostatic latent image is not developed, is larger than a peak-to-peak voltage of an AC bias voltage applied to said developer carrying member when the developer is collected and the electrostatic latent image is developed.

2. An apparatus according to claim 1, wherein the AC bias voltage applied by said bias voltage applying means is in the form of a rectangular wave.

3. An apparatus according to claim 1, wherein the AC bias voltage applied by said bias voltage applying means includes a DC component.

4. An apparatus according to claim 1, wherein said charging member is movable to and away from said image bearing member, and the developer comprises toner and electroconductive powder, and wherein the electroconductive power is fed to a contact portion between said charging member and said image bearing member by said image bearing member.

5. An apparatus according to claim 4, wherein a charging polarity of the electroconductive powder is opposite to a charging polarity of the toner.

6. An image forming apparatus comprising:

an image forming means;

an image bearing member for bearing an electrostatic latent image formed thereon by said image forming means;

a charging member for electrically charging said image bearing member;

developing means for developing with a developer the electrostatic latent image formed on said image bearing member, said developing means having a developer carrying member for carrying the developer, wherein a gap is formed between said developer carrying member and said image bearing member; and bias voltage applying means for applying a bias voltage to said developer carrying member, wherein said bias voltage applying means applies an AC bias voltage when the electrostatic latent image is developed, wherein said developing means is capable of collecting the developer from said image bearing member, and a duty ratio of an AC bias voltage applied to said developer carrying member by said bias voltage applying means when the developer is collected and the electrostatic latent image is not developed, is different from a duty ratio of an AC bias voltage when the developer is collected and the electrostatic latent image is developed.

7. An apparatus according to claim 6, wherein the duty ratio of the AC bias voltage applied to said developer carrying member by said bias voltage applying means when the developer is collected and the electrostatic latent image is not developed, has a larger percentage of a potential for moving the developer from said developer carrying member to said image bearing member than the duty ratio of the AC bias voltage when the developer is collected and the electrostatic latent image is developed.

8. An apparatus according to claim 6, wherein the AC bias voltage applied by said bias voltage applying means is in the form of a rectangular wave.

9. An apparatus according to claim 6, wherein the AC bias voltage applied by said bias voltage applying means includes a DC component.

10. An apparatus accoring to claim 6, wherein said charging member is movable to and away from said image bearing member, and the developer comprises toner and electronconductive powder, and wherein the electroconductive powder is fed to a contact portion between said charging member and said image bearing member by said image bearing member.

11. An apparatus according to claim 10, wherein a charging polarity of the electroconductive powder is opposite to a charging polarity of the toner.

12. An image forming apparatus comprising:

an image forming means;

an image bearing number for bearing an electrostatic latent image formed thereon by said image forming means;

a charging member for electrically charging said image bearing member;

developing means for developing with a developer the electrostatic latent image formed on said image bearing member, said developing means including a developer carrying member for carrying the developer, wherein a gap is formed between said developer carrying member and said image bearing member; and bias voltage applying means for applying a bias voltage to said developer carrying member, wherein said bias voltage applying means applies an AC bias voltage when the electrostatic latent image is developed, wherein said developing means is capable of collecting the developer from said image bearing member, and a frequency of an AC bias voltage applied to said developer carrying member by said bias voltage applying means when the developer is collected and the electrostatic latent image is not developed, is higher than a frequency of an AC bias voltage applied to said developer carrying member when the developer is collected and the electrostatic latent image is developed.

13. An apparatus according to claim 12, wherein the AC bias voltage applied by said bias voltage applying means is in the form of a rectangular wave.

14. An apparatus according to claim 12, wherein the AC bias voltage applied by said bias voltage applying means includes a DC component.

15. An apparatus according to claim 12, wherein said charging means is movable to and away from said image bearing member, and the developer comprises toner and electroconductive powder, and wherein the electroconductive powder is fed to a contact portion between said charging member and said image bearing member by said image bearing member.

16. An apparatus according to claim 15, wherein a charging polarity of the electroconductive powder is opposite to a charging polarity of the toner.

17. An image forming apparatus comprising:

an image forming means;

an image bearing member for bearing an electrostatic latent image formed thereon by said image forming means;

a charging number for electrically charging said image bearing member;

first bias voltage applying means for applying to said charging member a first bias voltage for formation of the electrostatic latent image on said image bearing member and a second bias voltage which is different from the first bias voltage;

developing means for developing with a developer the electrostatic latent image formed on said image bearing member, said developing means having a developer carrying member for carrying the developer, wherein a gap is formed between said developer carrying member and said image bearing member, and second bias voltage applying means for applying a bias voltage to said developer carrying member, wherein said second bias voltage applying means applies an AC bias voltage when the electrostatic latent image is developed, wherein such an area of said image bearing member as has been at a charging position while said first bias voltage applying means applies the second bias voltage passes through a developing position, said second bias voltage applying means applies an AC bias voltage having a peak-to-peak voltage which is larger than a peak-to-peak voltage of an AC bias voltage applied to said developer carrying member when the electrostatic latent imae is developed.

18. An apparatus according to claim 17, wherein the AC bias voltage applied by said second bias voltage applying means is in the form of a rectangular wave.

19. An apparatus according to claim 17, wherein the AC bias voltage applied by said second bias voltage applying means includes a DC component.

20. An apparatus according to claim 17, wherein the first bias voltage applied by said first bias voltage applying means is a DC bias voltage, and the second bias voltage is an AC bias voltage.

21. An apparatus according to claim 17, wherein the second bias voltage applied by said first bias voltage applying means performs a function of discharging the developer from said charging member.

22. An apparatus according to claim 17, wherein said charging member is movable to and away from said image bearing member, and the developer comprises toner and electroconductive powder, and wherein the electroconductive powder is fed to a contact portion between said charging member and said image bearing member by said image bearing member.

23. An apparatus according to claim 22, wherein a charging polarity of the electroconductive powder is opposite to a charging polarity of the toner.

24. An image forming apparatus comprising:

an image forming means;

an image bearing member for bearing an electrostatic latent image formed thereon by said image forming means;

a charging member for electrically charging said image bearing member;

first bias voltage applying means for applying to said charging member a first bias voltage for formation of the electrostatic latent image on said image bearing member and a second bias voltage which is different from the first bias voltage;

developing means for developing with a developer the electrostatic latent image formed on said image bearing member, said developing means having a developer carrying member for carrying the developer, wherein a gap is formed between said developer carrying member and said image bearing member; and second bias voltage applying means for applying a bias voltage to said developer carrying member;

wherein said second bias voltage applying means applies an AC bias voltage when the electrostatic latent image is developed, and wherein such an area of said image bearing member as has been at a charging position while said first bias voltage applying means applies the second bias voltage passes through a developing position, said second bias voltage applying means applies an AC bias voltage having a duty ratio which is different from a duty ratio of an AC bias voltage applied to said developer carrying member when the electrostatic latent image is developed.

25. An apparatus according to claim 24, wherein when a such an area of said image bearing member as has been at the charging position while said first bias voltage applying means applies the second bias voltage passes through the developing position, and second bias voltage applying means applies an AC bias voltage having a duty ratio which is larger than a duty ratio of an AC bias voltage applied to said developer carrying member when the electrostatic latent image is developed.

26. An apparatus according to claim 24, wherein the AC bias voltage applied by said second bias voltage applying means is in the form of a rectangular wave.

27. An apparatus according to claim 24, wherein the AC bias voltage applied by said second bias voltage applying means includes a DC component.

28. An apparatus according to claim 24, wherein the first bias voltage applied by said first bias voltage applying means is a DC bias, and the second bias voltage is an AC bias voltage.

29. An apparatus accordting to claim 24, wherein the second bias voltage applied by said first bias voltage applying means performs a function of discharging said charging member.

30. An apparatus according to claim 24, wherein said charging member is movable to and away from said image bearing member, and the developer comprises toner and electroconductive powder, and wherein the electroconductive powder is fed to a contact portion between said charging member and said image bearing member by said image bearing member.

31. An apparatus according to claim 30, wherein a charging polarity of the electroconductive powder is opposite to a charging polarity of the toner.

32. An image forming apparatus comprising:

an image forming means;

an image bearing member for bearing an electrostatic latent image formed thereon by said image forming means;

a charging member for electrically charging said image bearing member;

first bias voltage applying means for applying to said charging member a first bias voltage for formation of the electrostatic latent image on said image bearing member and a second bias voltage which is different from the first bias voltage;

developing means for developing with a developer the electrostatic latent image formed on said image bearing member, said developing means having a developer carrying member for carrying the developer, wherein a gap is formed between said developer carrying member and said image bearing member; and second bias voltage applying means for applying a bias voltage to said developer carrying member, wherein said second bias voltage applying means applies an AC bias voltage when the electrostatic latent image is developed, and wherein when such an area of said image bearing member as has been at a charging position while said first bias voltage applying means applies the second bias voltage passes through a developing position, said second bias voltage applying means applies an AC bias voltage having a frequency which is higher than a frequency of an AC bias voltage applied to said developer carrying member when the electrostatic latent image is developed.

33. An apparatus according to claim 32, wherein the AC bias voltage applied by said second bias voltage applying means is in the form of a rectangular wave.

34. An apparatus according to claim 32, wherein the AC bias voltage applied by said second bias voltage applying means includes a DC component.

35. An apparatus according to claim 32, wherein the first bias voltage applied by said first bias voltage applying means is a DC bias voltage, and the second bias voltage is an AC bias voltage.

36. An apparatus according to claim 32, wherein the second bias voltage applied by said first bias voltage applying means performs a function of discharging the developer from said charging member the image bearing member.

37. An apparatus according to claim 32, wherein said charging member is movable to and away from said image bearing member, and the developer comprises toner and electroconductive powder, and wherein the electroconductive powder is fed to a contact portion between said charging member and said image bearing member by said image bearing member.

38. An apparatus according to claim 37, wherein a charging polarity of the electroconductive powder is opposite to a charging polarity of the toner.

39. An apparatus according to claim 1, 6, 12, 17, 24, or 32, wherein said charging member is contacted to said image bearing member.

40. An apparatus according to claim 39, wherein said charging member and said image bearing member move in opposite peripheral directions at a contact portion between said charging member and said image bearing member.

* * * * *

UNITED STATES PATENT AND TRADEMARK OFFICE

CERTIFICATE OF CORRECTION

PATENT NO. : 7,031,629 B2
APPLICATION NO. : 10/413482
DATED : April 18, 2006
INVENTOR(S) : Takeshi Kawamura et al.

It is certified that error appears in the above-identified patent and that said Letters Patent is hereby corrected as shown below:

ON THE TITLE PAGE

Item (56), U.S. Patent Documents, "4,999,782 A * 3/1991 BeVan" should read --5,999,782 * 12/1999 Iguchi et al.--.

Item (56), Foreign Patent Documents, "2000122388 A" should read --2000-122388 A--; and "2000267407 A" should read --2000-267407 A--.

Item (57), Abstract, line 13, "fro" should read --from--.

COLUMN 10

Line 52, "fail" should read --fails--.

COLUMN 12

Line 30, "In" should read --in--.

COLUMN 15

Line 40, "drum 1" should read --drum 1.--.

UNITED STATES PATENT AND TRADEMARK OFFICE

CERTIFICATE OF CORRECTION

PATENT NO. : 7,031,629 B2
APPLICATION NO. : 10/413482
DATED : April 18, 2006
INVENTOR(S) : Takeshi Kawamura et al.

It is certified that error appears in the above-identified patent and that said Letters Patent is hereby corrected as shown below:

COLUMN 19
Line 30, “bias” should read --bias.--.

COLUMN 25
Line 1, “power” should read --powder--.

COLUMN 27
Line 56, “a” should be deleted; and
Line 60, “and” should read --said--.

COLUMN 28
Line 67, “member” should read --member to--.

Signed and Sealed this

Fourteenth Day of November, 2006

JON W. DUDAS
*Director of the United States Patent and Trademark Office*